US011124955B2

(12) United States Patent
Shiohara et al.

(10) Patent No.: US 11,124,955 B2
(45) Date of Patent: Sep. 21, 2021

(54) FLUSH TOILET

(71) Applicant: TOTO LTD., Kitakyushu (JP)

(72) Inventors: Eiji Shiohara, Kitakyushu (JP); Satoshi Takano, Kitakyushu (JP); Hideyuki Nakatsu, Kitakyushu (JP); Yuki Kubota, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 151 days.

(21) Appl. No.: 16/579,669

(22) Filed: Sep. 23, 2019

(65) Prior Publication Data

US 2020/0095756 A1 Mar. 26, 2020

(30) Foreign Application Priority Data

Sep. 25, 2018 (JP) ..... JP2018-178982
Sep. 25, 2018 (JP) ..... JP2018-178983
Sep. 25, 2018 (JP) ..... JP2018-178984
Sep. 25, 2018 (JP) ..... JP2018-178985

(51) Int. Cl.
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC ..... E03D 11/08
USPC ..... 4/420
See application file for complete search history.

(56) References Cited

U.S. PATENT DOCUMENTS

2015/0275494 A1* 10/2015 Kashirajima ..... E03D 11/02 4/420

FOREIGN PATENT DOCUMENTS

JP 2017-166315 A 9/2017

* cited by examiner

*Primary Examiner* — Lauren A Crane
(74) *Attorney, Agent, or Firm* — Studebaker & Brackett PC

(57) ABSTRACT

A flush toilet includes a first rim spout port provided in a rim on one side in a left-right direction of a bowl and a second rim spout port provided in the rim on the other side in the left-right direction of the bowl. The first rim spout port is disposed further in the front than the front end of a well portion. The second rim spout port causes the second rim spout to traverse a swirling direction of a swirling flow of the first rim spout and guide the flush water interfering with the swirling flow of the first rim spout to a rear region of the bowl further on the rear side than the well portion.

10 Claims, 8 Drawing Sheets

〈Before joining〉

〈After joining〉

FLUSH TOILET

BACKGROUND OF THE INVENTION

Field of the Invention

The present invention relates to a flush toilet and, more particularly, to a flush toilet configured to discharge waste by flushing the flush toilet with flush water supplied from a flush water source.

Description of the Related Art

There has been known, as a flush toilet in the past that is configured to discharge waste by flushing the flush toilet with flush water supplied from a flush water source, a flush toilet including two rim spout ports, that is, a first rim spout port and a second rim spout port, for example, as described in Patent document 1 (Japanese Patent Unexamined Publication No. 2017-166315).

In such a flush toilet in the past, the first rim spout port is disposed on a rim wall surface on the left side of a bowl when a toilet main body is viewed from the front and further in the rear than the front end of a well portion that stores reserved water. Consequently, large-flow rate flush water is spouted forward from the first rim spout port as first rim spout. A swirling flow is formed in the bowl.

On the other hand, the second rim spout port of the flush toilet in the past described above is disposed on a rim wall surface in the right rear of the bowl of the toilet main body and further in the rear than the rear end of the well portion. Consequently, small-flow rate flush water is spouted from the second rim spout port as second rim spout in the same direction as the direction of the swirling flow of the first rim spout port.

The flush water can be supplied over the entire circumference in the bowl to clean the entire bowl by these two rim spout ports.

However, in the bowl of the flush toilet in the past described above in Patent Literature 1, there are a region where waste easily adheres and a region where waste less easily adheres.

As the region where waste easily adheres, specifically, there is, for example, a rear region of the bowl on the rear side of the well portion that stores reserved water. Therefore, it is desirable to supply high-speed and large-flow rate flush water to a wide range of such a rear region of the bowl.

However, in the flush toilet described in Patent Literature 1, the first rim spout port is disposed on the rim wall surface on the left side of the bowl and further in the rear than the front end of the well portion. Therefore, the swirling flow of the first rim spout spouted from the first rim spout port swirls to the rear side through the front side in the bowl. Most of the first rim spout drops to the well portion before reaching the rear region of the bowl.

Therefore, the first rim spout reaching the rear region of the bowl is supplied to the rear region of the bowl at a small-flow rate and reduced flow speed.

Further, in the flush toilet described in Patent Literature 1, the second rim spout spouted from the second rim spout port is spouted in a swirl shape in the same direction as the direction of the swirling flow of the first rim spout. Therefore, even if the first rim spout reaching the rear region of the bowl joins the second rim spout in the rear region of the bowl, the first rim spout and the second rim spout less easily drop to the well portion. Cleaning performance is insufficient in the rear region of the bowl where waste easily adheres.

Accordingly, it is important how to improve cleaning power by supplying sufficient flush water to the rear region of the rear region of the bowl where waste easily adheres.

SUMMARY OF THE INVENTION

Therefore, the present invention has been devised to solve the problems of the related art described above, and an object of the present invention is to provide a flush toilet that can efficiently supply high-speed and large-flow rate flush water to the rear region of the bowl where waste easily adheres and can improve cleaning power for the rear region of the bowl.

In order to solve the problems described above, the present invention provides a flush toilet that is cleaned by flush water supplied from a flush water source to discharge waste, the flush toilet including: a bowl including a bowl-shaped waste receiving surface, a rim formed above the waste receiving surface, and a well portion provided below the waste receiving surface and configured to store reserved water and form sealing water; a discharge trap portion, an inlet of which is connected to the well portion to discharge the waste; a first rim spout portion provided in the rim on one side in a left-right direction of the bowl and configured to perform first rim spout for spouting the flush water forward and form a swirling flow swirling along the rim; and a second rim spout portion provided in the rim on another side in the left-right direction of the bowl and configured to perform second rim spout for spouting the flush water having a flow rate smaller than a flow rate of the first rim spout portion. The first rim spout portion includes a first rim spout port disposed further in a front than a front end of the well portion. The second rim spout portion includes a second rim spout port configured to cause the second rim spout to traverse a swirling direction of the swirling flow of the first rim spout and guide the flush water interfering with the swirling flow of the first rim spout to a rear region of the bowl further on a rear side than the well portion.

In the present invention configured in this way, since the first rim spout port of the first rim spout portion is disposed further in the front than the front end of the well portion of the bowl, it is possible to efficiently guide the swirling flow of the high-speed and large-flow rate first rim spout to the rear region of the bowl (the waste receiving surface and the rim further on the rear side than the well portion).

The second rim spout can be performed by the second rim spout port of the second rim spout portion to traverse the swirling direction of the swirling flow of the first rim spout spouted from the first rim spout port of the first rim spout portion. Therefore, it is possible to cause the swirling flow of the high-speed and large-flow rate first rim spout to join and efficiently interfere with a water flow of the second rim spout.

Consequently, even if the swirling flow of the first rim spout is guided in a higher-speed and larger-flow rate state to the rear region of the bowl as the first rim spout port of the first rim spout portion is disposed further in the front than the front end of the well portion of the bowl, it is possible to prevent the swirling flow of the first rim spout from becoming less easily drop in the rear region of the bowl after interfering with the second rim spout.

Therefore, it is possible to efficiently supply, to the rear region of the bowl where waste easily adheres, the high-speed and large-flow rate first rim spout in a state in which the first rim spout interferes with the second rim spout. Therefore, it is possible to improve cleaning power of the first rim spout and the second rim spout that clean the waste receiving surface and the rim further on the rear region side than the well portion of the bowl.

In the present invention, preferably, the second rim spout port is disposed further in the front than a rear end of the well portion.

In the present invention configured in this way, since the second rim spout port of the second rim spout portion is disposed further in the front than the rear end of the well portion, the swirling flow of the first rim spout spouted from the first rim spout port can be caused to join and interfere with the water flow of the second rim spout spouted by the second rim spout port relatively earlier in terms of timing.

Therefore, a part of the swirling flow of the high-speed and large-flow rate first rim spout can be dropped to an upstream side of the rear region of the bowl as well. Consequently, since the rear region of the bowl where waste easily adheres and an upstream side region of the rear region can be cleaned in a wide range, it is possible to improve the cleaning power.

In the present invention, preferably, the second rim spout port is disposed further in the rear than the front end of the well portion.

In the present invention configured in this way, since the second rim spout port is disposed further in the rear than the front end of the well portion, it is possible to prevent the swirling flow of the first rim spout spouted from the first rim spout port from joining and interfering with the water flow of the second rim spout spouted by the second rim spout port from being excessively earlier in terms of timing.

Therefore, it is possible to prevent most of the swirling flow of the high-speed and large-flow rate first rim spout from dropping early further on the upstream side than the rear region of the bowl.

In the present invention, preferably, the second rim spout port is disposed further in the rear than a center in a front-rear direction of the well portion.

In the present invention configured in this way, since the second rim spout port is disposed further in the rear than the center in the front-rear direction of the well portion, it is possible to cause, immediately before the rear region of the bowl, the swirling flow of the high-speed and large-flow rate first rim spout to join and interfere with the water flow of the second rim spout spouted to traverse the swirling flow from the second rim spout port. It is possible to moderately drop a part of the flush water after the joining. Consequently, it is possible to efficiently clean, in a wide range, the waste receiving surface and the rim in the rear region of the bowl where waste easily adheres.

In the present invention, preferably, an opening end face of the second rim spout port is directed obliquely rearward such that the water flow of the second rim spout traverses a left-right direction of the rear region of the bowl.

In the present invention configured in this way, since the opening end face of the second rim spout port is directed obliquely rearward, the water flow of the second rim spout spouted from the second rim spout port can be directed obliquely rearward to traverse the left-right direction of the rear region of the bowl. Consequently, it is possible to guide the swirling flow of the high-speed and large-flow rate first rim spout and the water flow of the second rim spout, which is spouted obliquely rearward, over the entire left-right direction of the rear region of the bowl while causing the swirling flow of the first rim spout and the water flow of the second rim spout to interfere.

In the present invention, preferably, the second rim spout port includes a diffusing portion configured to diffuse the second rim spout in a film shape more widely than the swirling flow of the first rim spout.

In the present invention configured in this way, the second rim spout can be radially diffused by the diffusing portion of the second rim spout port toward the rear region of the bowl obliquely rearward from the second rim spout port. Consequently, since the second rim spout can be formed in the film shape more widely than the swirling flow of the first rim spout, it is possible to guide the swirling flow of the high-speed and large-flow rate first rim spout and the wide film-like water flow of the second rim spout spouted obliquely rearward to a wide range over the entire left-right direction and front-rear direction of the rear region of the bowl while causing the swirling flow of the first rim spout and the water flow of the second rim spout to interfere.

In the present invention, preferably, the diffusing portion is provided such that a direction of a channel center axis of the diffusing portion forms an angle with respect to a contact plane of a rim wall surface near a rear end of the second rim spout port in the rim.

In the present invention configured in this way, since the direction of the channel center axis of the diffusing portion of the second rim spout port forms the angle with respect to the contact plane of the rim wall surface near the downstream side of the second rim spout port in the rim, it is possible to spout the second rim spout from the second rim spout port toward the rear region of the obliquely rearward bowl, it is possible to radially diffuse the spouted second rim spout to effectively traverse the swirling direction of the swirling flow of the first rim spout and form a wide film-like water flow.

Further, it is possible to suppress a phenomenon in which the second rim spout is drawn to rim wall surfaces near the front and the rear of the second rim spout port in the rim (a so-called Coanda phenomenon).

Accordingly, it is possible to prevent the second rim spout from flowing in the same swirling direction together with the swirling flow of the first rim spout. It is possible to prevent all the flush water after the joining from simply swirling without dropping at all in the rear region of the bowl.

Consequently, it is possible to effectively guide the swirling flow of the high-speed and large-flow rate first rim spout and the wide film-like water flow of the second rim spout, which is spouted obliquely rearward, over the entire left-right direction and front-rear direction of the rear region of the bowl while causing the swirling flow of the first rim spout and the water flow of the second rim spout to join and moderately interfere.

In the present invention, preferably, the flush toilet further includes a second rim conduit configured to guide the flush water supplied from the flush water source to the second rim spout portion, the second rim conduit includes a first bent conduit that turns rearward the flush water flowing forward from the upstream side of the second rim conduit and a second bent conduit provided in the rear on the downstream side of the first bent conduit, the second bent conduit includes a bent portion that turns obliquely rearward the flush water turned to flow rearward by the first bent conduit, and the diffusing portion is provided further on the downstream side than the bent portion.

In the present invention configured in this way, the flush water supplied from the flush water source to the second rim conduit flows forward from the upstream side of the second rim conduit and is turned to flow rearward by the first bent conduit. Thereafter, the flush water passed through the first bent conduit passes through the diffusing portion of the second rim spout port after being turned obliquely rearward in the bent portion of the second bent conduit.

At this time, when the flush water flowing rearward from the first bent conduit to the second bent conduit is turned obliquely rearward in the bent portion of the second bent conduit, the flow speed of the flush water can be reduced. Consequently, when the second rim spout is spouted from the second rim spout port passing through the diffusing portion of the second rim spout port, the second rim spout is easily radially diffused obliquely rearward from the second rim spout port. Therefore, a wide film-like water flow of the second rim spout can be formed.

Consequently, it is possible to cause the film-like second rim spout, which is wide compared with the first rim spout, to traverse the swirling direction of the swirling flow of the high-speed and large-flow rate first rim spout. Therefore, it is possible to cause the first rim spout and the second rim spout to effectively interfere.

It is possible to effectively suppress the phenomenon in which the second rim spout spouted from the second rim spout port is drawn to the rim wall surfaces near the front and the rear of the second rim spout port in the rim (a so-called Coanda phenomenon). Accordingly, it is possible to effectively prevent the second rim spout from flowing in the same swirling direction together with the swirling flow of the first rim spout and prevent all the flush water after the joining from simply swirling without dropping at all in the rear region of the bowl.

In the present invention, preferably, the diffusing portion is a downstream side conduit formed further on the downstream side than the bent portion of the second bent conduit, and width of the downstream side conduit is set larger than width of a conduit further on the upstream side than the bent portion in the second bent conduit.

In the present invention configured in this way, the diffusing portion is the downstream side conduit formed further on the downstream side than the bent portion of the second bent conduit. The width of the downstream side conduit can be set larger, namely wider, than the width of the conduit further on the upstream side than the bent portion in the second bent conduit.

Consequently, by turning obliquely rearward, in the bent portion of the second bent conduit, the flush water flowing rearward from the first bent conduit to the second bent conduit and thereafter causing the flush water to pass through the downstream side conduit of the second bent conduit, it is possible to effectively radially diffuse the second rim spout spouted obliquely rearward from the second rim spout port and form the wide film-like second rim spout.

Therefore, it is possible to more effectively guide the flush water over the entire left-right direction and front-rear direction of the rear region of the bowl while causing the swirling flow of the high-speed and large-flow rate first rim spout and the wide film-like water flow of the second rim spout spouted obliquely rearward to join and moderately interfere.

In the present invention, preferably, in the rear region of the bowl, a surface formed obliquely rearward from the second rim spout port on the waste receiving surface of the bowl is inclined to rise toward the rear side.

In the present invention configured in this way, the surface formed obliquely rearward from the second rim spout port on the waste receiving surface of the rear region of the bowl is inclined to rise toward the rear side. Therefore, it is possible to prevent most of the flush water after the interference of the first rim spout and the second rim spout in the rear region of the bowl from swirling to the front side of the bowl along the wall surface of the rim above the waste receiving surface of the rear region of the bowl.

Therefore, it is possible to make it easy to drop a part of the flush water passing the rear region of the bowl after the interference of the first rim spout and the second rim spout in the rear region of the bowl.

Accordingly, it is possible to prevent all the flush water after the joining in the rear region of the bowl from simply swirling without dropping at all.

In the present invention, preferably, in the rear region of the bowl, an upper edge of the waste receiving surface formed on a circumferential direction rear side of the bowl from a bottom surface of the second rim spout port is inclined to rise from the front side toward a rear end of the rim.

In the present invention configured in this way, since the upper edge of the waste receiving surface formed on the circumferential direction rear side of the bowl from the bottom surface of the second rim spout port is inclined to rise from the front side toward the rear end of the rim, it is possible to effectively prevent most of the flush water after the interference of the first rim spout and the second rim spout in the rear region of the bowl from swirling to the front side of the bowl along the wall surface of the rim above the waste receiving surface of the rear region of the bowl.

Therefore, it is possible to make it easy to effectively drop a part of the flush water passing the rear region of the bowl after the interference of the first rim spout and the second rim spout in the rear region of the bowl.

The present invention provides a flush toilet that is cleaned by flush water supplied from a flush water source to discharge waste, the flush toilet including: a bowl including a bowl-shaped waste receiving surface, a rim formed above the waste receiving surface, and a well portion provided below the waste receiving surface and configured to store reserved water and form sealing water; a discharge trap portion, an inlet of which is connected to the well portion to discharge the waste; a first rim spout portion provided in the rim on one side in a left-right direction of the bowl and configured to perform first rim spout for spouting the flush water forward and form a swirling flow swirling along the rim; and a second rim spout portion provided in the rim on another side in the left-right direction of the bowl and configured to perform second rim spout for spouting the flush water having a flow rate smaller than a flow rate of the first rim spout portion. The first rim spout portion includes a first rim spout port disposed further in a front than a front end of the well portion. The second rim spout portion includes a second rim spout port configured to cause the second rim spout to traverse a swirling direction of the swirling flow of the first rim spout and guide the flush water interfering with the swirling flow of the first rim spout to a rear region of the bowl further on a rear side than the well portion. The second rim spout port includes a diffusing portion configured to diffuse the second rim spout in a film shape more widely than the swirling flow of the first rim spout.

In the present invention, preferably, the diffusing portion is configured to guide the second rim spout spouted from the second rim spout port to traverse a left-right direction of the rear region of the bowl.

In the present invention, preferably, the diffusion portion is configured to be capable of, after causing at least a part of the second rim spout spouted from the second rim spout port to traverse the left-right direction of the rear region of the bowl, swirling the part of the second rim spout to the first rim spout port side along a wall surface of the rim in the rear region of the bowl.

In the present invention, preferably, the diffusing portion is provided such that a direction of a channel center axis of the diffusing portion forms an angle with respect to a contact plane of a rim wall surface near a rear end of the second rim spout port in the rim.

In the present invention, preferably, the flush toilet further includes a second rim conduit configured to guide the flush water supplied from the flush water source to the second rim spout portion, the second rim conduit includes a first bent conduit that turns rearward the flush water flowing forward from the upstream side of the second rim conduit and a second bent conduit provided in the rear on the downstream side of the first bent conduit, the second bent conduit includes a bent portion that turns obliquely rearward the flush water turned to flow rearward by the first bent conduit, and the diffusing portion is provided further on the downstream side than the bent portion.

In the present invention, preferably, the diffusing portion is a downstream side conduit formed further on the downstream side than the bent portion of the second bent conduit, and width of the downstream side conduit is set larger than width of a conduit further on the upstream side than the bent portion in the second bent conduit.

The present invention provides a flush toilet that is cleaned by flush water supplied from a flush water source to discharge waste, the flush toilet including: a bowl including a bowl-shaped waste receiving surface, a rim formed above the waste receiving surface, and a well portion provided below the waste receiving surface and configured to store reserved water and form sealing water; a discharge trap portion, an inlet of which is connected to the well portion to discharge the waste; a first rim spout portion provided in the rim on one side in a left-right direction of the bowl and configured to perform first rim spout for spouting the flush water forward and form a swirling flow swirling along the rim; and a second rim spout portion provided in the rim on another side in the left-right direction of the bowl and configured to perform second rim spout for spouting the flush water having a flow rate smaller than a flow rate of the first rim spout portion. The first rim spout portion includes a first rim spout port disposed further in a front than a front end of the well portion. The second rim spout portion is configured to cause the second rim spout to traverse a swirling direction of the swirling flow of the first rim spout and guide the flush water interfering with the swirling flow of the first rim spout to a rear region of the bowl further on a rear side than the well portion. The second rim spout portion includes a second rim spout port disposed further in a rear than a center in a front-rear direction of the bowl. The second rim spout port includes a drop-flow facilitating portion configured to, before the swirling flow of the first rim spout reaches a region where the swirling flow joins and interferes with the second rim spout in the rear region of the bowl, facilitate formation of a water flow in which the second rim spout drops to the well portion through the rear region of the bowl.

In the present invention, preferably, the drop-flow facilitating portion is configured to, before the swirling flow of the first rim spout reaches the region where the swirling flow joins and interferes with the second rim spout in the rear region of the bowl, spout the second rim spout obliquely rearward to cause the second rim spout to traverse the left-right direction of the rear region of the bowl in advance.

In the present invention, preferably, the drop-flow facilitating portion is configured to be a diffusing portion configured to, before the swirling flow of the first rim spout reaches the region where the swirling flow joins and interferes with the second rim spout in the rear region of the bowl, diffuse the second rim spout in a film shape more widely than the swirling flow of the first rim spout in advance.

In the present invention, preferably, the diffusing portion is configured to, before the swirling flow of the first rim spout reaches the region where the swirling flow joins and interferes with the second rim spout in the rear region of the bowl, diffuse the second rim spout such that a film-like water flow is formed over substantially the entire rear region of the bowl by the second rim spout spouted from the second rim spout port.

In the present invention, preferably, the diffusing portion is provided such that a direction of a channel center axis of the diffusing portion forms an angle with respect to a contact plane of a rim wall surface near a rear end of the second rim spout port in the rim.

In the present invention, preferably, the flush toilet further includes a first rim conduit and a second rim conduit configured to guide the flush water supplied from the flush water source respectively to the first rim spout portion and the second rim spout portion, the second rim conduit is set to a path length smaller than a path length of the first rim conduit, the second rim conduit includes a first bent conduit that turns rearward the flush water flowing forward from the upstream side of the second rim conduit and a second bent conduit provided in the rear on the downstream side of the first bent conduit, the second bent conduit is configured to turn obliquely rearward the flush water turned to flow rearward by the first bent conduit, and the downstream side of the second bent conduit is the diffusing portion.

In the present invention, preferably, the diffusing portion is a downstream side conduit formed further on the downstream side than the bent portion of the second bent conduit, and width of the downstream side conduit is set larger than width of a conduit further on the upstream side than the bent portion in the second bent conduit.

The present invention provides a flush toilet that is cleaned by flush water supplied from a flush water source to discharge waste, the flush toilet including: a bowl including a bowl-shaped waste receiving surface, a rim formed above the waste receiving surface, and a well portion provided below the waste receiving surface and configured to store reserved water and form sealing water; a discharge trap portion, an inlet of which is connected to the well portion to discharge the waste; a first rim spout portion provided in the rim on one side in a left-right direction of the bowl and configured to perform first rim spout for spouting the flush water forward and form a swirling flow swirling along the rim; and a second rim spout portion provided in the rim on another side in the left-right direction of the bowl and configured to perform second rim spout for spouting the flush water having a flow rate smaller than a flow rate of the first rim spout portion. The first rim spout portion includes a first rim spout port disposed further in a front than a front end of the well portion. The second rim spout portion includes a second rim spout port configured to cause the second rim spout to traverse a swirling direction of the swirling flow of the first rim spout and guide the flush water interfering with the swirling flow of the first rim spout to a rear region of the bowl further on a rear side than the well portion. The second rim spout port includes a swirling maintaining portion configured to maintain swirling of the flush water after the swirling flow of the first rim spout spouted from the first rim spout port and a water flow of the second rim spout spouted from the second rim spout port are caused to interfere and enable the flush water to swirl to the first rim spout port along a wall surface of the rim.

In the present invention, preferably, the swirling maintaining portion is configured to set flow speed at a spout start of the second rim spout spouted from the second rim spout port lower than flow speed of the swirling flow of the first rim spout immediately before the interference with the second rim spout.

In the present invention, preferably, the swirling maintaining portion is configured to be a diffusing portion configured to spout the second rim spout in a first direction from the second rim spout port to the rear region of the bowl and spout the second rim spout in a second direction same as a swirling direction of the swirling flow of the first rim spout to thereby diffuse the second rim spout in a film shape more widely than the swirling flow of the first rim spout.

In the present invention, preferably, the diffusing portion is configured to set a first flow rate of the second rim spout in the first direction larger than a second flow rate of the second rim spout in the second direction.

In the present invention, preferably, the second rim spout port is disposed from a rear end of a rim wall surface of the rim to a predetermined rim wall surface on a front upstream side of a circumferential direction, and a curvature radius in a plan view of the predetermined rim wall surface is larger than a curvature radius in a plan view of the rear end of the rim wall surface.

In the present invention, preferably, the diffusing portion is provided such that a direction of a channel center axis of the diffusing portion forms an angle with respect to a contact plane of a rim wall surface near a rear end of the second rim spout port in the rim.

In the present invention, preferably, the flush toilet further includes a second rim conduit configured to guide the flush water supplied from the flush water source to the second rim spout portion, the second rim conduit includes a first bent conduit that turns rearward the flush water flowing forward from the upstream side of the second rim conduit and a second bent conduit provided in the rear on the downstream side of the first bent conduit, the second bent conduit includes a bent portion that turns obliquely rearward the flush water turned to flow rearward by the first bent conduit, and the diffusing portion is provided further on the downstream side than the bent portion.

In the present invention, preferably, the diffusing portion is a downstream side conduit formed further on the downstream side than the bent portion of the second bent conduit, and width of the downstream side conduit is set larger than width of a conduit further on the upstream side than the bent portion in the second bent conduit.

With the flush toilet of the present invention, it is possible to efficiently supply the high-speed and large-flow rate flush water to the rear region of the bowl where waste easily adheres and improve cleaning power for the rear region of the bowl.

DETAILED DESCRIPTION OF THE PREFERRED EMBODIMENTS

A flush toilet according to an embodiment of the present invention is explained with reference to FIGS. 1 to 7B.

Figure 1:
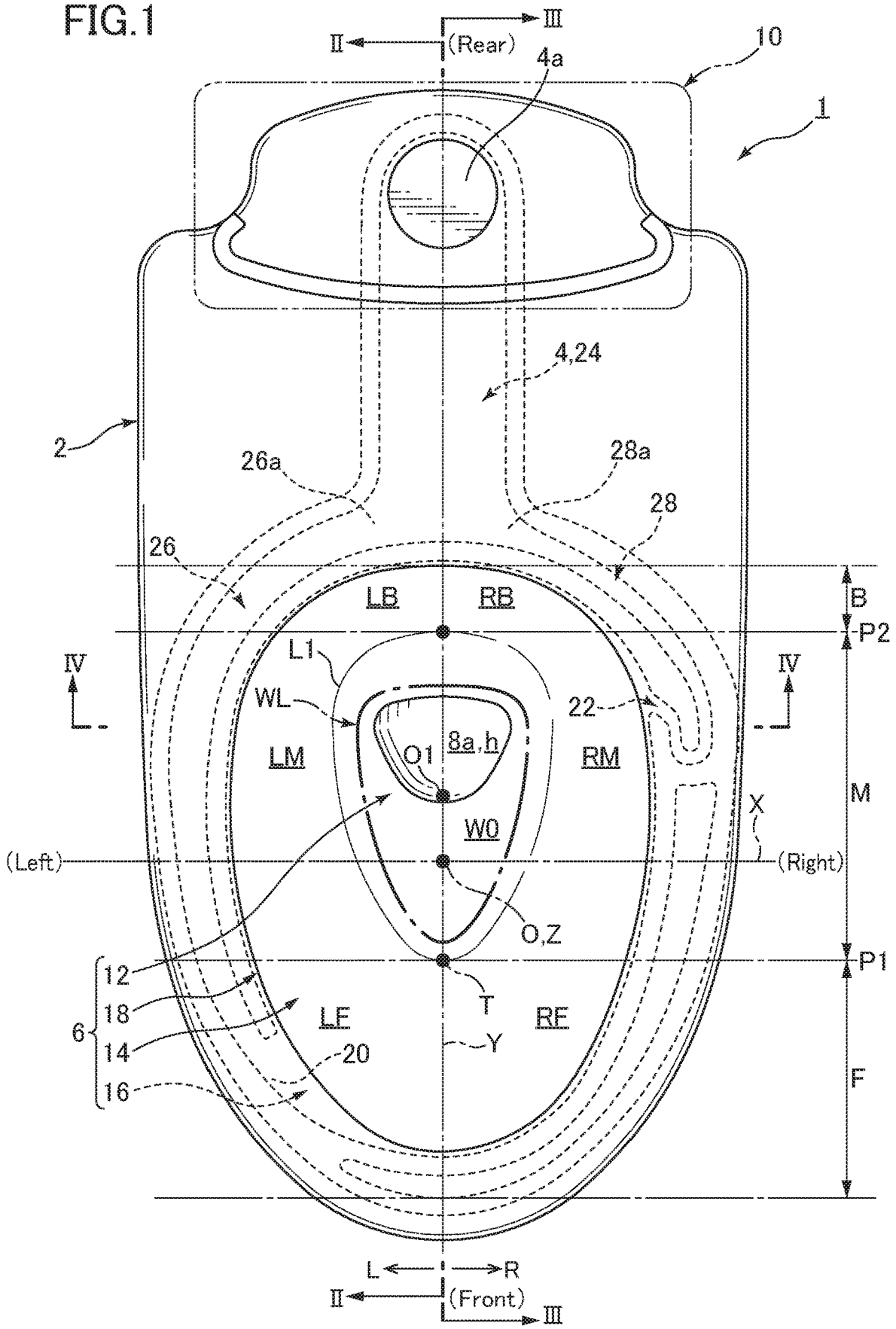
FIG. 1 is a schematic plan view of a flush toilet according to an embodiment of the present invention.

First, FIG. 1 is a schematic plan view of a flush toilet according to the embodiment of the present invention.

As shown in FIG. 1, a flush toilet 1 according to the embodiment of the present invention includes a toilet main body 2 made of ceramics. The toilet main body 2 includes, from an upstream side toward a downstream side, a conduit 4, a bowl 6 having a bowl shape, and a discharge trap conduit 8.

The toilet main body 2 may be made of resin other than the ceramics.

A toilet seat (not shown in FIG. 1), a toilet lid (not shown in FIG. 1), and the like are provided on the upper surface of the toilet main body 2 of the flush toilet 1 according to this embodiment shown in FIG. 1. However, the toilet seat, the toilet lid, and the like are the same as the structure of the flush toilet in the past. Therefore, detailed explanation of the toilet seat, the toilet lid, and the like is omitted.

On the upper surface of the toilet main body 2, a sanitary cleaning portion (not shown in FIG. 1) that cleans the private part of a user and a functional portion (not shown in FIG. 1) such as a water supply system functional portion involved in a water supply function to the toilet main body 2 may also be provided on the rear side of the toilet seat (not shown in FIG. 1) and the toilet lid (not shown in FIG. 1). The sanitary cleaning portion and the functional portion are also the same as the structure of the flush toilet in the past. Therefore, specific explanation of the sanitary cleaning portion and the functional portion is omitted.

As shown in FIG. 1, the flush toilet 1 according to the embodiment of the present invention is a so-called "wash-off type flush toilet" including a water storage tank 10 of a gravity water supply type described above, which is a flush water source that stores flush water used for toilet cleaning and supplies the flush water to the toilet main body 2, the wash-off type flush toilet washing away waste with flowing water action by a head drop of water in the bowl 6 of the toilet main body 2.

In this embodiment, a flush water source that supplies the flush water to the toilet main body 2 is not limited to a form of a tank type such as the water storage tank 10 of the gravity water supply type explained above. Other forms are also applicable. That is, the flush water source that supplies the flush water to the toilet main body 2 may be a form of a city-water direct pressure type that directly uses a water supply pressure of tap water or a form of a flush valve type or may be a form that supplies the flush water using supplementary pressure of a pump.

Figure 2:
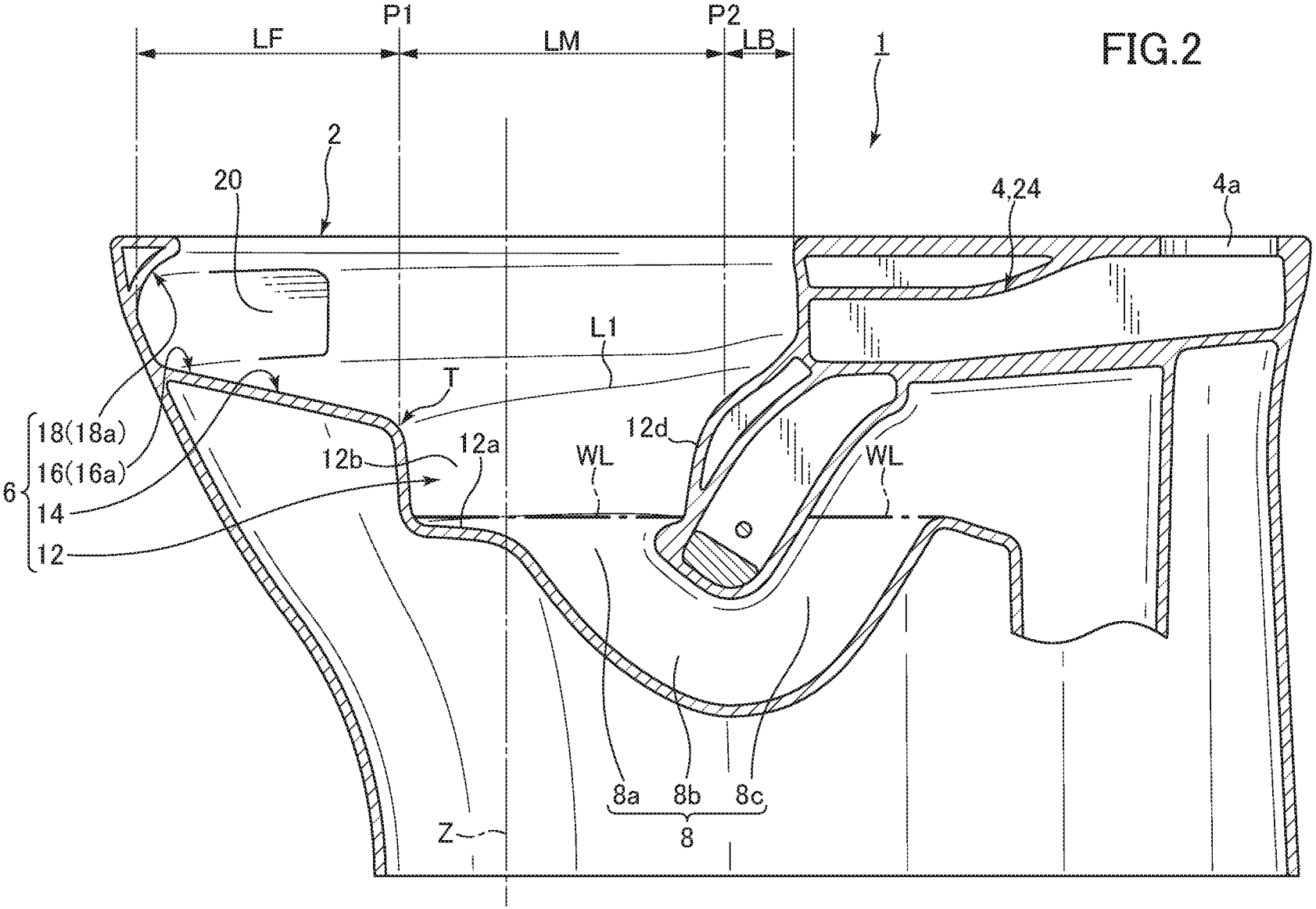
FIG. 2 is a sectional view taken along a II-II line in FIG. 1.
Figure 3:
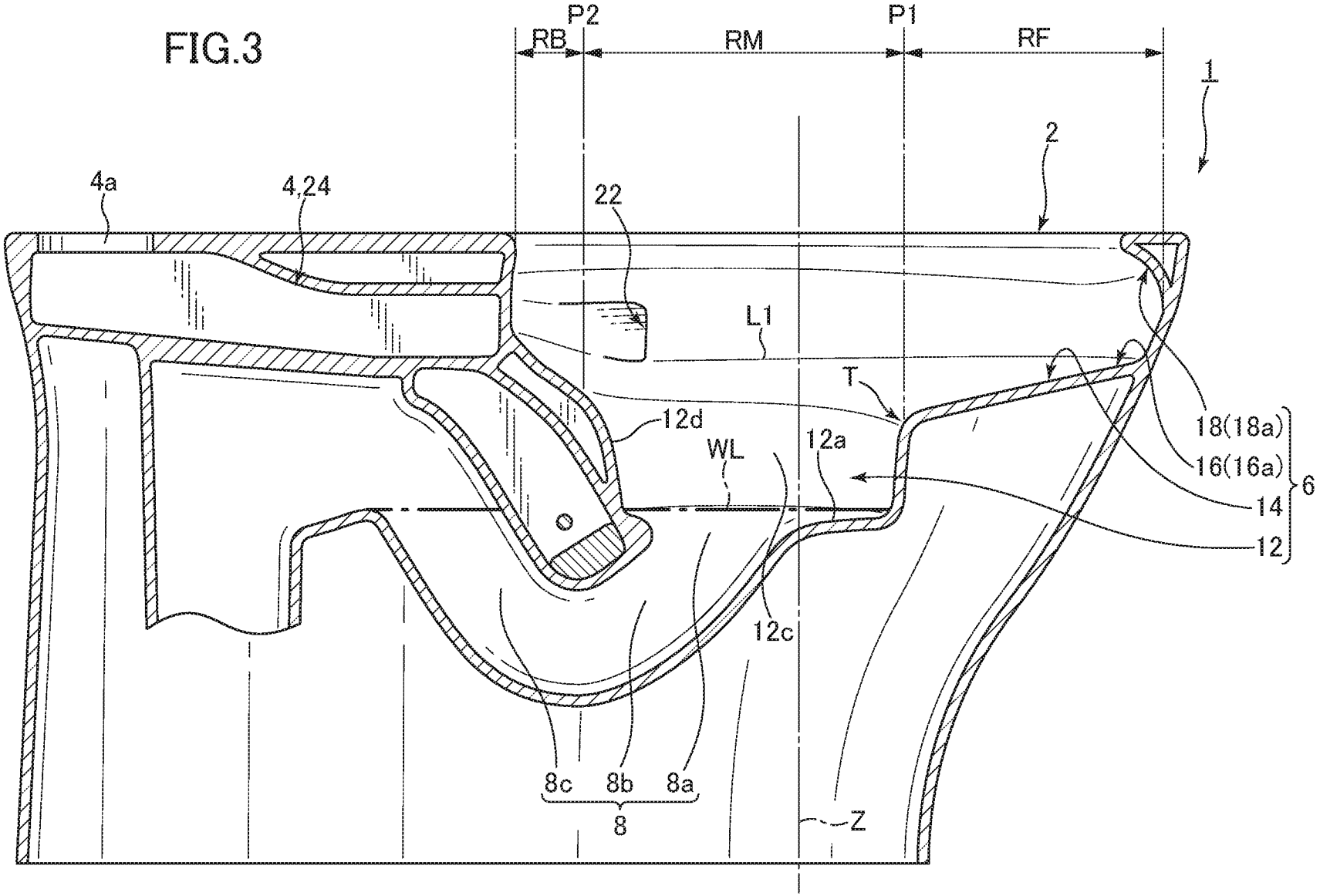
FIG. 3 is a sectional view taken along a III-III line in FIG. 1.
Figure 4:
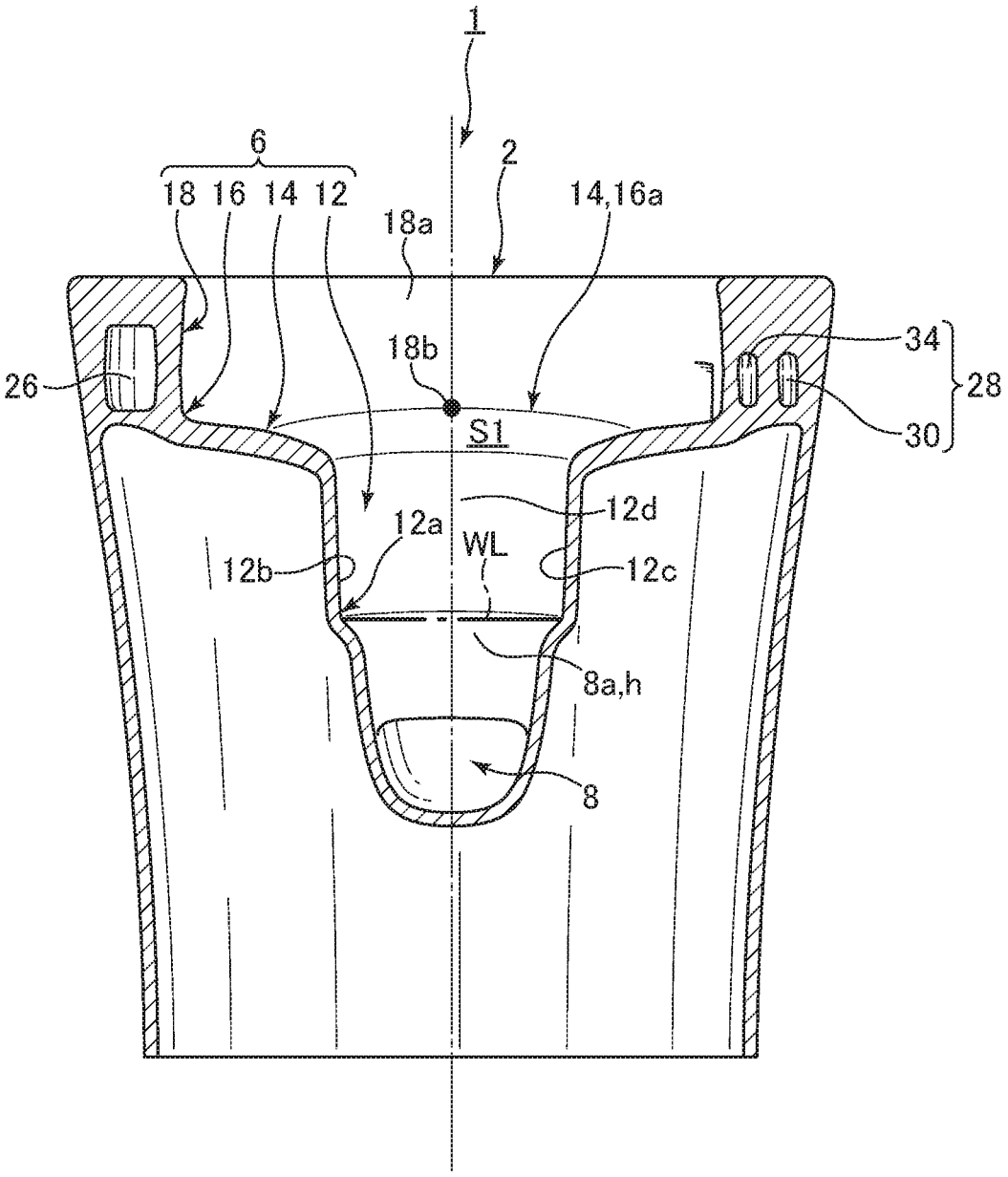
FIG. 4 is a sectional view taken along a IV-IV line in FIG. 1.

FIG. 2 is a sectional view taken along a II-II line in FIG. 1. FIG. 3 is a sectional view taken along a III-III line in FIG. 1. FIG. 4 is a sectional view taken along a IV-IV line in FIG. 1.

In the flush toilet 1 according to this embodiment shown in FIGS. 2 to 4, an exterior portion of the toilet main body 2 and the water storage tank 10 are omitted. Only main portions of the toilet main body 2 such as the bowl 6, the conduit 4, and the discharge trap conduit 8 of the toilet main body 2 explained below are shown as details.

In the flush toilet 1 according to the embodiment of the present invention shown in FIG. 1, in a plan view of the bowl 6 of the toilet main body 2, a center axis extending in the horizontal front-rear direction to equally divide the bowl 6 into two in the front-rear direction is indicated by "X" and a center axis extending in the horizontal front-rear direction to equally divide the bowl 6 into two in the left-right direction is indicated by "Y".

In FIG. 1, an intersection of the center axes X and Y is set as a center O of the bowl 6 in the plan view. A center axis extending in the vertical direction passing the center O is indicated by "Z".

Consequently, in the flush toilet 1 according to the embodiment of the present invention shown in FIGS. 2 and 3, in a side view of the bowl 6 of the toilet main body 2, a center axis extending in the vertical direction to equally divide the bowl into two in the front-rear direction is indicated by "Z".

Further, as shown in FIGS. 1 to 3, front, rear, left, and right directions of flush toilet 1 are respectively indicated by "front", "rear", "left", and "right".

As shown in FIGS. 1 to 4, the conduit 4 located on the upstream side of the toilet main body 2 is formed on the rear side of the bowl 6 and configured to guide the flush water supplied from the water storage tank 10 to the bowl 6.

As shown in FIGS. 1 to 4, the bowl 6 located on the downstream side of the conduit 4 of the toilet main body 2 includes, from down to up, a well portion 12, a waste receiving surface 14, a shelf 16, and a rim 18.

First, as shown in FIGS. 1 to 4, the well portion 12 of the bowl 6 is provided below the bowl 6. The well portion 12 stores reserved water W0 on the inside to form sealing water (a sealing water surface WL).

As shown in FIGS. 1 to 4, the well portion 12 includes a bottom wall 12*a*, sidewalls (a left sidewall 12*b* and a right sidewall 12*c*) provided on the left and right sides of the bottom wall 12*a*, and a rear wall 12*d* provided behind the bottom wall 12*a*.

Further, as shown in FIG. 1, the front side of the sidewalls 12*b* and 12*c* on both the sides of the well portion 12 is formed in a tapered shape in which the sidewalls 12*b* and 12*c* approach each other from the rear toward the front in the plan view. The front end of the well portion 12 is a distal end portion T.

As shown in FIGS. 1 to 3, in the flush toilet 1 according to this embodiment, concerning a region in the bowl 6, a region at the upper ends of both the sidewalls 12*b* and 12*c* of the well portion 12 and further on the front side than a front end position P1 (the distal end portion T) is defined as "front region F of the bowl 6". In the front region F of the bowl 6, a left side region L and a right side region R with respect to the center axis Y in the horizontal front-rear direction of the bowl 6 are respectively defined as "a left front region LF of the bowl 6" and "a right front region RF of the bowl 6".

Similarly, a region at the upper end of the well portion 12 and further on the rear side than a rear end position P2 is defined as "a rear region B of the bowl 6". In the rear region B of the bowl 6, a left side region L and a right side region R with respect to the center axis Y in the horizontal front-rear direction of the bowl 6 are respectively defined as "a left rear region LB of the bowl 6" and "a right rear region RB of the bowl 6".

As shown in FIGS. 1 to 3, in the flush toilet 1 according to this embodiment, a region between the front region F and the rear region B in the bowl 6 is defined as "an intermediate region M of the bowl 6". In the intermediate region M of the bowl 6, a region further on the left side than the upper edge of the left sidewall 12*b* of the well portion 12 is defined as "a left side region LM of the bowl 6" and a region further on the right side than the upper edge of the right sidewall 12*c* of the well portion 12 is defined as "a right side region RM of the bowl 6".

As shown in FIGS. 1 to 4, the waste receiving surface 14 of the bowl 6 forms a bowl surface having a bowl shape from the lower edge connected to the upper edge of the well portion 12 together with a shelf surface 16*a* of the shelf 16 and rim inner wall surface 18*a* of the rim 18. The waste receiving surface 14 serves as a surface that receives waste.

In FIGS. 1 to 4, a boundary line between the well portion 12 and the waste receiving surface 14 (the upper edge of the well portion 12 and the lower edge of the waste receiving surface 14) is represented as "L1".

The rim 18 of the bowl 6 forms the upper edge of the bowl 6. The inner circumferential surface (the rim inner wall surface 18*a*) of the rim 18 is formed in a generally oval shape in the plan view shown in FIG. 1.

Further, the shelf 16 of the bowl 6 is formed between the outer edge of the waste receiving surface 14 and the lower end of the rim 18. The flush water in the conduit 4 is guided to each of two rim spout ports (a first rim spout port 20 and a second rim spout port 22) explained in detail below. Consequently, a first rim spout and a second rim spout are respectively spouted from the first rim spout port 20 and the second rim spout port 22.

In the present invention, the shelf 16 does not always need to be provided. The first rim spout and the second rim spout may be spouted to the upper edge portion of the waste receiving surface 14 respectively from the first rim spout port 20 and the second rim spout port 22.

As shown in FIGS. 1 to 4, the conduit 4 includes a common conduit 24, a first rim conduit 26, and a second rim conduit 28.

The common conduit 24 is formed on the inside of the toilet main body 2 on the rear side of the bowl 6 to extend from a rear inlet 4*a* connected to the water storage tank 10 to the vicinity on the rear side of the bowl 6.

As shown in FIGS. 1, 2, and 4, the first rim spout port 20 is provided in the rim 18 in the left front region LF in the bowl 6 and disposed further in the front than the front end position P1 of the well portion 12.

As shown in FIGS. 1, 2, and 4, the first rim conduit 26 is formed on the inside of the rim 18 to, after branching to the left side of the bowl 6 from the common conduit 24 near the rear side of the bowl 6, extend to the first rim spout port 20 in the front while bypassing on the outer circumferential surface of the bowl 6.

Consequently, the flush water supplied from the common conduit 24 to the first rim conduit 26 is formed to, after being spouted as the first rim spout from the first rim spout port 20 to the shelf 16 in the front, form a swirling flow that swirls from the left front region LF to the right side region RM through the right front region RF in the bowl 6.

On the other hand, as shown in FIGS. 1, 3, and 4, the second rim spout port 22 is provided in the rim 18 in the right side region RM in the bowl 6 and is disposed further in the rear than the front end position P1 of the well portion 12 and further in the front than the rear end position P2 of the well portion 12.

The second rim spout port 22 is disposed further in the rear than the center in the front-rear direction of the well portion 12 (a center O1 in the front-rear direction of the well portion 12 shown in FIG. 1).

Further, as shown in FIGS. 1, 2, and 4, as explained in detail below, the second rim conduit 28 is formed to, after branching to the right side of the bowl 6 from the common conduit 24 near the rear side of the bowl 6, extend to the rim 18 in the right side region RM of the bowl 6 in the front while bypassing on the outer circumferential surface of the bowl 6.

Thereafter, the second rim conduit 28 is formed to, on the inside of the rim 18 in the right side region RM of the bowl 6, after making a U-turn to the rear side and extending to the rear, bend obliquely rearward to the second rim spout port 22 and extend to the second rim spout port 22.

As shown in FIGS. 1 to 4, the discharge trap conduit 8 located on the downstream side of the toilet main body 2 is a water discharge path (a discharge trap portion) formed from the bottom to the rear of the bowl 6 to discharge waste in the bowl 6.

An inlet 8*a* of the discharge trap conduit 8 is connected to a water discharge port h in the bottom (the bottom wall 12*a*) of the well portion 12 of the bowl 6. The discharge trap conduit 8 includes a descending path 8*b* descending from the inlet 8*a* downward and rearward and an ascending path 8*c* ascending upward and rearward from the downstream end of the descending path 8*b*.

Details of the second rim conduit 28 and the second rim spout port 22 in the flush toilet 1 according to this embodiment are explained with reference to FIGS. 1 and 3 to 6.

Figure 5:
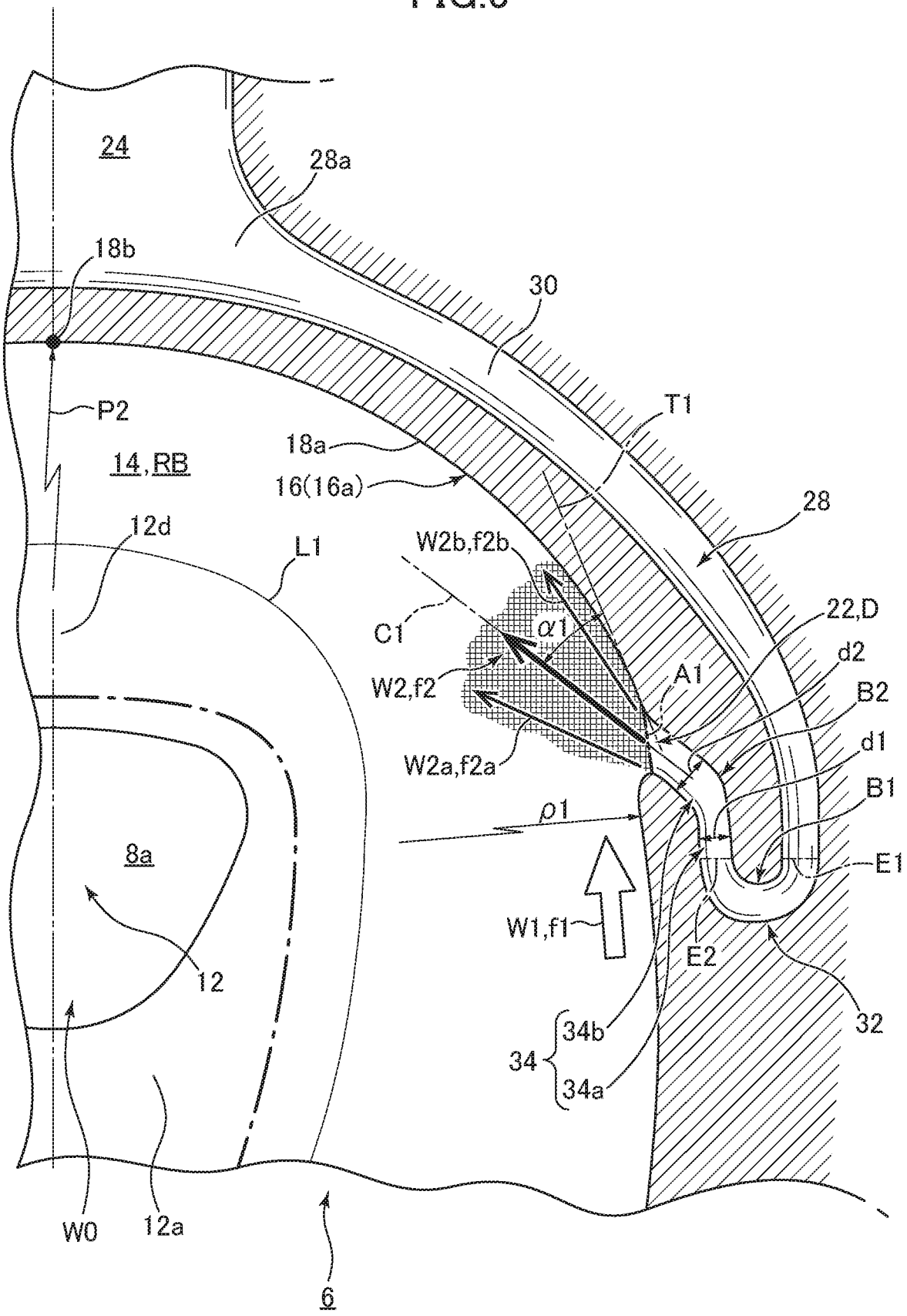
FIG. 5 is a partially enlarged plan view of a portion of a bowl including a second rim conduit and a second rim spout port in a toilet main body of the flush toilet according to the embodiment of the present invention shown in FIG. 1.
Figure 6:
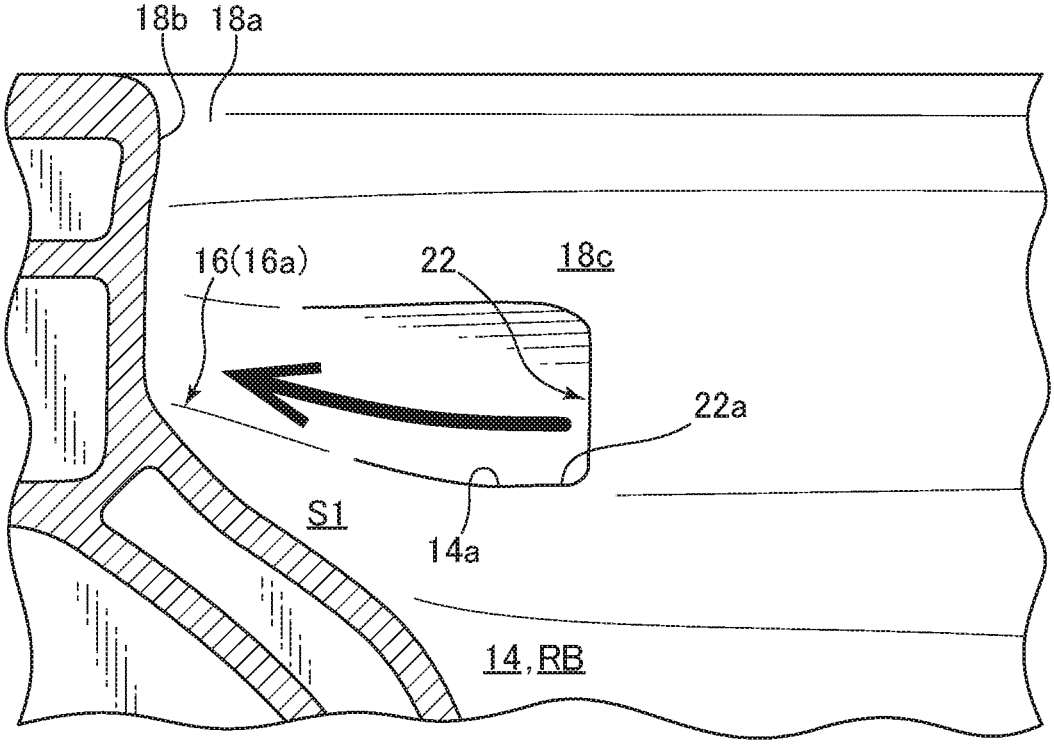
FIG. 6 is a partially enlarged view of a portion of the second rim spout port in the toilet main body of the flush toilet according to the embodiment of the present invention shown in FIG. 3.

First, FIG. 5 is a partially enlarged plan view of a portion of the bowl including the second rim conduit and the second rim spout port in the toilet main body of the flush toilet according to the embodiment of the present invention shown in FIG. 1. FIG. 6 is a partially enlarged view of a portion of the second rim spout port in the toilet main body of the flush toilet according to the first embodiment of the present invention shown in FIG. 3.

As shown in FIG. 5, the second rim conduit 28 includes an outer conduit 30, a first bent conduit 32, and a second bent conduit 34 from an inlet 28*a* of the second rim conduit 28 toward the downstream side.

As shown in FIG. 5, the inlet 28*a* of the outer conduit 30 of the second rim conduit 28 is connected to the common conduit 24 on the rear side (the upstream side). The outer conduit 30 is formed in the rim 18 of the right side region RM of the bowl 6 in the front while bypassing on the outer circumferential surface of the bowl 6.

As shown in FIG. 5, the first bent conduit 32 of the second rim conduit 28 is formed to bend reward in a bent portion B1 after extending forward from a front end (a downstream end) E1 of the outer conduit 30. That is, the bent portion B1 of the first bent conduit 32 is a portion turning in a U-shape in the plan view of FIG. 5. Consequently, the flush water flowing into the first bent conduit 32 forward from the outer conduit 30 on the upstream side is turned rearward by passing through the first bent conduit 32.

As shown in FIG. 5, the second bent conduit 34 of the second rim conduit 28 is provided in the rear on the downstream side of the first bent conduit 32. The second bent conduit 34 includes an upstream side conduit 34*a* extending from a downstream end E2 of the first bent conduit 32 to a bent portion B2 in the rear and a downstream side conduit 34*b* extending to the second rim spout port 22 after being bent toward the right rear region RB of the bowl 6 in the oblique rear by the bent portion B2.

Consequently, the flush water flowing into the upstream side conduit 34*a* of the second bent conduit 34 rearward from the downstream end E2 of the first bent conduit 32 is turned obliquely rearward to the right rear region RB of the bowl 6 by passing through the bent portion B2 of the second bent conduit 34. The flush water passing through the downstream side conduit 34*b* is spouted as the second spout from the second rim spout port 22.

As shown in FIGS. 1 and 5, a path length from the inlet 28*a* of the second rim conduit 28 to the second rim spout port 22 is set to length smaller than a path length from an inlet 26*a* of the first rim conduit 26 to the first rim spout port 20.

An average channel sectional area in a path from the inlet 28*a* of the second rim conduit 28 to the second rim spout port 22 is set smaller than an average channel sectional area in a path from the inlet 26*a* of the first rim conduit 26 to the first rim spout port 20.

Consequently, each of a spout amount V2 [L] and a flow rate Q2 (an instantaneous flow rate) [L/min] of the second rim spout spouted from the second rim spout port 22 is set smaller than each of a spout amount V1 [L] and a flow rate Q1 (an instantaneous flow rate) [L/min] of the first spout spouted from the first rim spout port 20 (V2<V1, Q2<Q1).

Incidentally, in the flush toilet 1 according to this embodiment, for example, when a total spout amount V [L] of flush water W supplied from the water storage tank 10 to the common conduit 24 is set to 100%, the spout amount V1 [L] of a first rim spout W1 supplied from the common conduit 24 to the first rim conduit 26 is desirably set to 70% to 80% of the total spout amount V [L] and the spout amount V2 [L] of a second rim spout W2 supplied from the common conduit 24 to the second rim conduit 28 is desirably set to 20% to 30% of the total spout amount V0 [L].

As shown in FIG. 5, the second rim spout port 22 includes a diffusing portion D that diffuses a water flow f2 of the second rim spout W2 in a film shape more widely than a swirling flow f1 of the first rim spout W1.

The diffusing portion D also functions as drop-flow facilitating portion that facilitates formation of an inner water flow f2*a* in which a part of the water flow f2 of the second rim spout W2 drops to the well portion 12 through the right rear region RB of the bowl 6.

The diffusing portion D also functions as a swirling maintaining portion that maintains swirling performance of flush water W3 in the rear region B of the bowl 6 after the swirling flow f1 of the first rim spout W1 spouted from the first rim spout port 20 and a water flow f2 of the second rim spout W2 spouted from the second rim spout port 22 join and interfere. Consequently, the flush water W3 after the joining in the rear region B of the bowl 6 is capable of swirling to the left front region LF of the bowl 6 near the first rim spout port 20 after swirling to the left side region LM of the bowl 6.

As a specific structure of the diffusing portion D of the second rim spout port 22, in the plan view shown in FIG. 5, the diffusing portion D is provided such that a direction of a channel center axis C1 of the downstream side conduit 34*b* of the second bent conduit 34 and the second rim spout port 22 forms a predetermined angle $\alpha 1$ ($0° < \alpha 1 < 90°$) with respect to a contact plane T1 of the rim inner wall surface 18*a* near the rear end of the second rim spout port 22 in the rim 18.

The predetermined angle $\alpha 1$ formed by the channel center axis C1 and the contact plane T1 in the plan view shown in FIG. 5 is desirably set to 10 degrees to 25 degrees and most desirably set to 15 degrees to 20 degrees. With the configuration explained above, the second rim spout W2 from the second rim spout port 22 obliquely traverses a swirling direction of the swirling flow f1 from the first rim spout port 20, at an angle of 10 to 25 degrees, more desirably 15 to 20 degrees and joins the swirling flow f1.

That is, as shown in FIG. 5, an opening end face A1 of the second rim spout port 22 described above is directed obliquely rearward to the right rear region RB of the bowl 6 by the diffusing portion D of the second rim spout port 22.

Consequently, a part of the water flow f2 of the second rim spout W2 spouted from the second rim spout port 22 to the right rear region RB of the bowl 6 in advance can flow down into the well portion 12 from the rear side. The remaining part of the water flow f2 of the second rim spout W2 can traverse the left-right direction from the right rear region RB to the left rear region LB of the bowl 6.

On the other hand, as shown in FIGS. 1 and 5, when swirling to the right side region RM and reaching near the second rim spout port 22 through the left front region LF to the right front region RF in the bowl 6, the first rim spout W1 spouted forward from the first rim spout port 20 can join and interfere with the water flow f2 of the second rim spout W2 spouted toward the right rear region RB of the bowl 6 in advance and traversing a swirling direction of the first rim spout W1.

As shown in FIG. 5, in the diffusing portion D of the second rim spout port 22, a channel width d2 of the downstream side conduit 34*b* of the second bent conduit 34 is set larger than a channel width d1 of the upstream side conduit 34*a* of the second bent conduit 34.

Consequently, by turning obliquely rearward, in the bent portion B2 of the second bent conduit 34, flush water flowing reward from the first bent conduit 32 to the second bent conduit 34 and thereafter causing the flush water to pass through the downstream side conduit 34*b* of the second bent conduit 34, it is possible to effectively radially diffuse the second rim spout W2 spouted obliquely rearward from the second rim spout port 22 and form the second rim spout W2 widely in a film shape.

As shown in FIGS. 3 to 6, on the waste receiving surface 14 in the right rear region RB of the bowl 6, an inclined surface S1 formed obliquely reward from the second rim spout port 22 is inclined to rise toward the rear side.

As shown in FIGS. 3 to 6, in the right rear region RB of the bowl 6, an upper edge 14*a* of the waste receiving surface 14 and the shelf surface 16*a* of the shelf 16 formed on the circumferential direction rear side of the bowl 6 from a bottom surface 22*a* of the second rim spout port 22 are inclined to rise from the front side toward the rear end of the rim inner wall surface 18*a* (a rim inner wall surface rear end 18*b*).

Further, as shown in FIGS. 5 and 6, the second rim spout port 22 is disposed on a predetermined rim inner wall surface 18*c* on the front upstream side in the circumferential direction from the rim inner wall surface rear end 18*b* of the rim 18. A curvature radius $\rho 1$ in a plan view of the predetermined rim inner wall surface 18*c* is set larger than a curvature radius $\rho 2$ in a plan view of the rim inner wall surface rear end 18*b* ($\rho 1 > \rho 2$).

Action of the flush toilet 1 according to the embodiment of the present invention is explained with reference to FIGS. 1 to 7B.

Figure 7A:
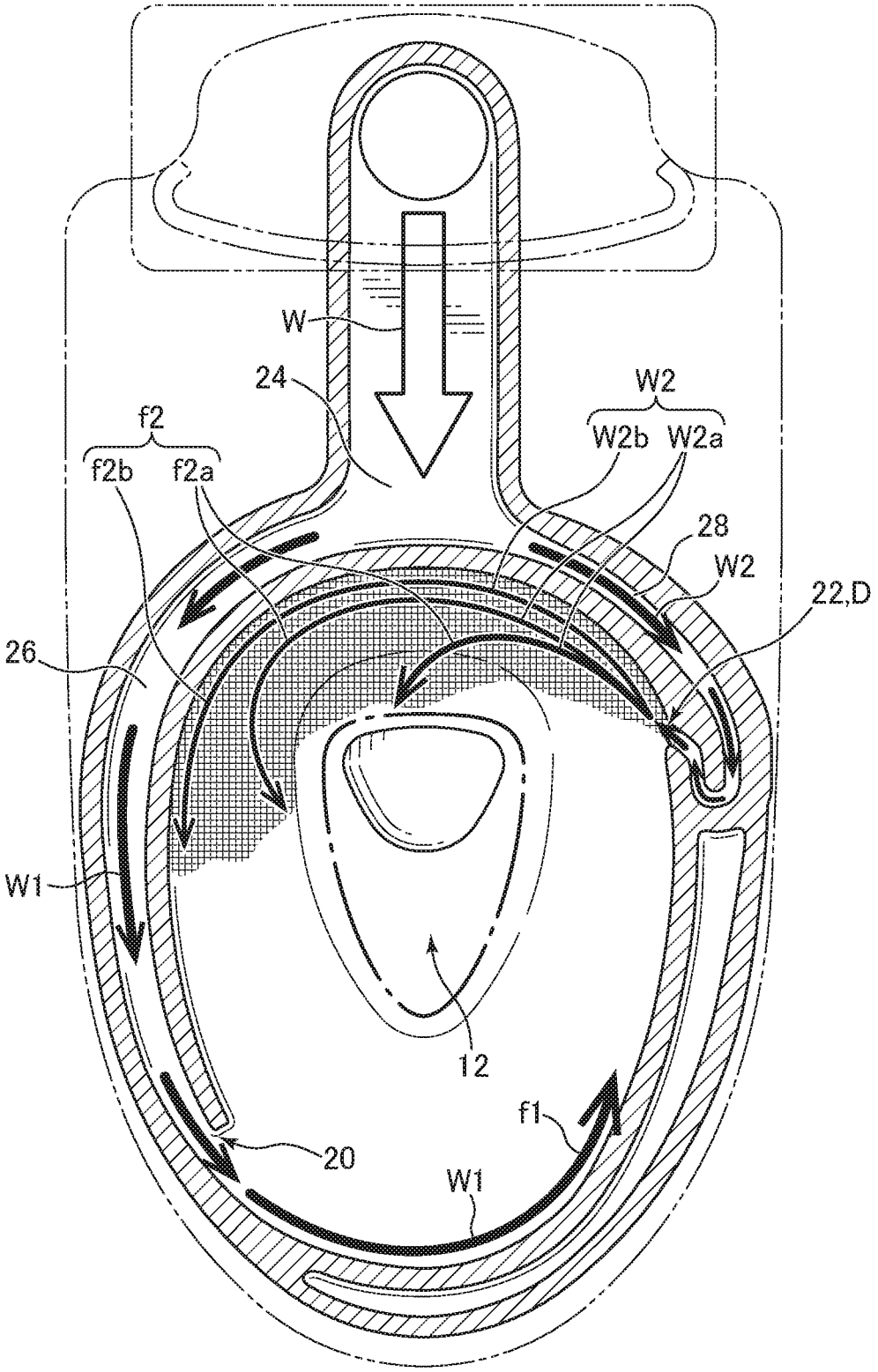
FIG. 7A is a schematic plan view for schematically explaining a flow of flush water in a state before a swirling flow of a first rim spout joins a water flow of a second rim spout on the inside of the bowl of the flush toilet according to the embodiment of the present invention.

FIG. 7A is a schematic plan view for schematically explaining a flow of flush water in a state before a swirling flow of the first rim spout joins a water flow of the second rim spout on the inside of the bowl of the flush toilet according to the embodiment of the present invention.

Figure 7B:
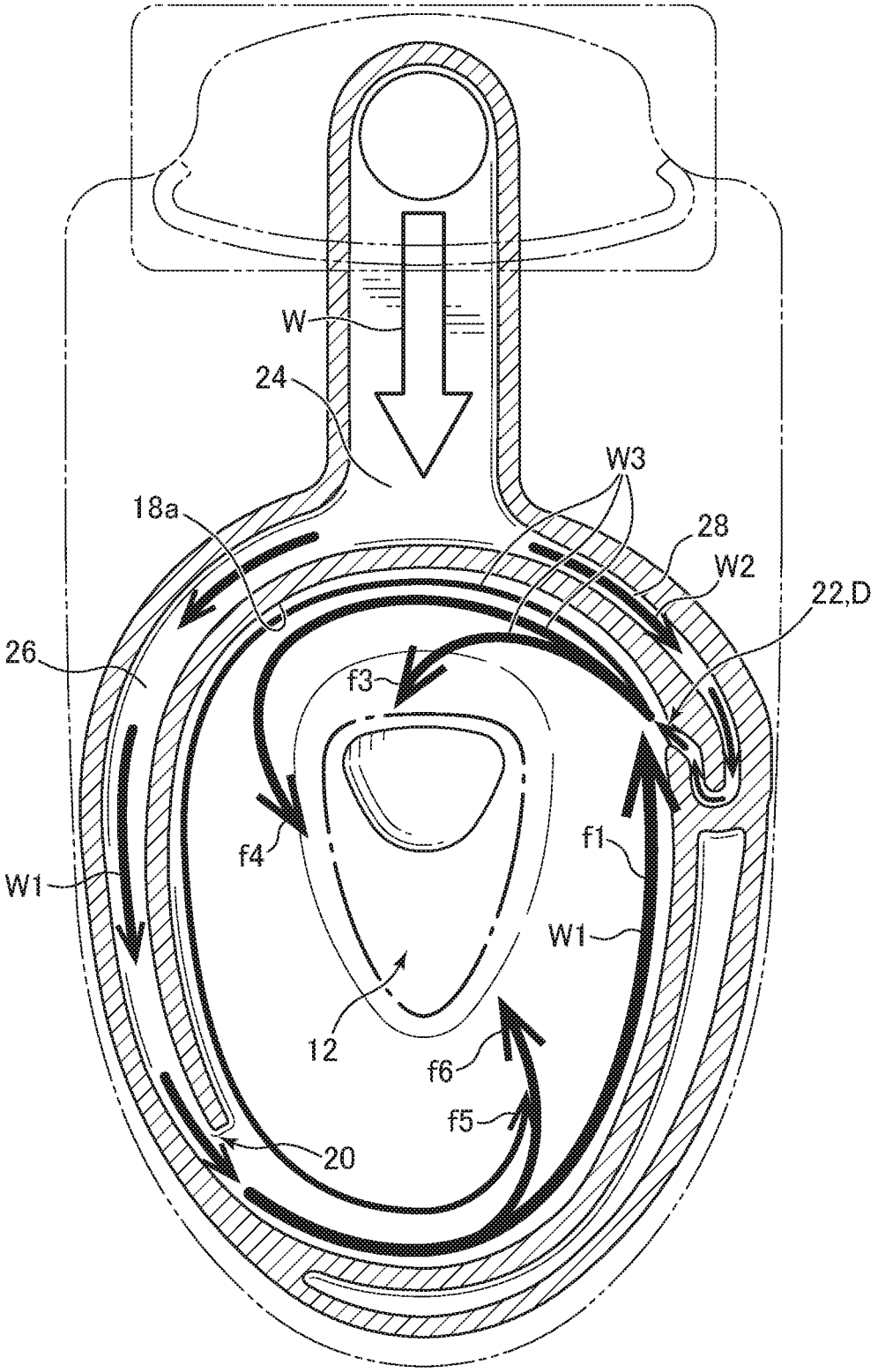
FIG. 7B is a schematic plan view for schematically explaining a flow of the flush water in a state after the swirling flow of the first rim spout joins the water flow of the second rim spout on the inside of the bowl of the flush toilet according to the embodiment of the present invention.

FIG. 7B is a schematic plan view for schematically explaining a flow of the flush water in a state after the swirling flow of the first rim spout joins the water flow of the second rim spout on the inside of the bowl of the flush toilet according to the embodiment of the present invention.

First, as shown in FIGS. 1 and 7A, toilet cleaning is started and the flush water in the water storage tank 10 is supplied from the inlet 4*a* of the conduit 4 of the toilet main body 2 to the common conduit 24. The flush water W in the common conduit 24 branch to each of the first rim conduit 26 and the second rim conduit 28 as each of first flush water W1 and second flush water W2.

As shown in FIGS. 1 and 7A, the first flush water W1 in the first rim conduit 26 is spouted as a first rim spout W1 forward from the first rim spout port 20 on the downstream side. The first rim spout W1 forms the swirling flow f1 that swirls from the left front region LF to the right-side region RM through the right front region RF in the bowl 6.

On the other hand, as shown in FIGS. 1,5, and 7A, the second flush water W2 in the second rim conduit 28 flows into the first bent conduit 32 in the front from the outer conduit 30 and is turned and flows rearward by passing through the bent portion B1 of the first bent conduit 32.

Thereafter, the second flush water W2 passed through the first bent conduit 32 flows into the upstream side conduit 34*a* of the second bent conduit 34 behind the first bent conduit 32 and, after being turned to the downstream side conduit 34*b* in the oblique rear in the bent portion B2 of the second bent conduit 34, passes through the downstream side conduit 34*b*, which is the diffusing portion D of the second rim spout port 22.

The second flush W2 is spouted from the second rim spout port 22 as the second rim spout W2. The second rim spout W2 is diffused toward the right rear region RB in the bowl 6 and forms the film-like water flow f2 wider than the swirling flow f1 of the first rim spout W1.

Since the second rim conduit 28 is set to a path length smaller than a path length of the first rim conduit 26, the second rim spout W2 is performed at early timing from the second rim spout port 22 in advance before the swirling flow f1 of the first rim spout W1 reaches a region where the swirling flow f1 joins and interferes with the water flow f2 of the second rim spout W2 in the right rear region RB of the bowl 6.

As shown in FIGS. 5 and 7A, the water flow f2 of the second rim spout W2 immediately after a spout start from the second rim spout port 22 is formed in a wide film-like shape spreading generally in a fan shape from the upstream side toward the downstream side in the plan view.

Further, the water flow f2 of the second rim spout W2 immediately after the spout start forms a wide film-like water flow generally in a range between an inner water flow f2*a* and an outer water flow f2*b*.

As shown in FIGS. 5 and 7A, the inner flow water flow f2*a* of a second rim spout W2*a* is a water flow of the second rim spout W2*a* in the first direction from the second rim spout port 22 toward the rear region B of the bowl 6.

On the other hand, the outer water flow f2*b* of the second rim spout W2 is a water flow of a second rim spout W2*b* in the second direction same as the swirling direction of the swirling flow f1 of the first rim spout W1.

The inner water flow f2*a* of the second rim spout W2*a* is in a state in which a flow rate of the inner water flow f2*a* (a first flow rate Q2*a* [L/min]) is larger than a flow rate of the outer water flow f2*b* (a second flow rate Q2*b* [L/min]) (Q2*a*>Q2*b*).

Subsequently, as shown in FIGS. 1, 5, and 7B, when the swirling flow f1 of the first rim spout W1 spouted from the first rim spout port 20 swirls to the right side region RM from left front region LF through the right front region RF in the bowl 6 and reaches near the second rim spout port 22, the swirling flow f1 joins and interferes with the water flow f2 of the second rim spout W2 that is spouted toward the right rear region RB of the bowl 6 in advance and traverses the swirling direction of the first rim spout W1.

Consequently, as shown in FIG. 79, the flush water W3 after the joining of the first rim spout W1 and the second rim spout W2 is guided to the right rear region RB of the bowl 6 further on the rear side than the well portion 12. A water flow f3, which is a part of the flush water W3, flows down into the well portion 12 from the rear side.

As shown in FIG. 7B, a water flow f4, which is a part of the flush water W3 after the joining guided to the right rear region RB of the bowl 6 swirls from the left rear region LB to the left side region LM of the bowl 6 and thereafter flows into the well portion 12 from the left side.

On the other hand, as shown in FIG. 7B, a water flow f5, which is the remaining part of the flush water W3 after the joining in the right rear region RB of the bowl 6 swirls from the left rear region LB to the front region F through the left side region LM of the bowl 6.

As shown in FIG. 7B, the water flow f5 in the front region F of the bowl 6 changes to a water flow f6 by, in the front region F of the bowl 6, joining a water flow that branches early from the swirling flow f1 of the first rim spout W1 and flows down. The water flow f6 flows into the well portion 12 from the front side.

Consequently, the waste receiving surface 14 and the rim 18 in the rear region B of the bowl 6 where waste easily adheres are cleaned in a wide range by the flush water W3 after the joining. The waste cleaned in the bowl 6 is discharged from the well portion 12 to the discharge trap conduit 8.

In the flush toilet 1 according to the embodiment of the present invention explained above, the first rim spout port 20 is disposed further in the front than the front end T of the well portion 12 of the bowl 6.

Consequently, the circulating flow f1 of the high-speed first rim spout W1 having the large flow rate Q1 [L/min] can be efficiently guided to the waste receiving surface 14 and the rim 18 further on the rear side than the well portion 12 in the rear region B in the bowl 6.

The second rim spout W2 can be performed by the second rim spout port 22 to cause the second rim spout W2 to traverse the swirling direction of the swirling flow f1 of the first rim spout W1 spouted from the first rim spout port 20. Therefore, it is possible to cause the circulating flow f1 of the high-speed first rim spout W1 having the large flow rate Q1 [L/min] to join and efficiently interfere with the water flow f2 of the second rim spout W2.

Consequently, even if the swirling flow f1 of the first rim spout W1 is guided in a higher-speed and larger-flow rate state to the rear region B of the bowl 6 as the first rim spout port 20 is disposed further in the front than the front end T of the well portion 12 of the bowl 6, it is possible to prevent the swirling flow f1 of the first rim spout W1 from becoming less easily drop in the rear region B of the bowl 6 after interfering with the second rim spout W2.

Further, prior to causing the swirling flow f1 of the first rim spout W1 to interfere with the water flow f2 of the second rim spout W2, before the swirling flow f1 of the first rim spout W1 reaches a region (the right rear region RB of the bowl 6) where the swirling flow f1 joins and interferes with the water flow f2 of the second rim spout W2 in the rear region B of the bowl 6 (before the joining), the second rim spout W2 can be spouted from the second rim spout port 22 to form the water flow f2 of the second rim spout W2 in the rear region B of the bowl 6 in advance by the drop-flow facilitating portion D of the second rim spout port 22. It is possible to facilitate the formation of the water flow f2 in which the second rim spout W2 drops to the well portion 12 through the rear region B of the bowl 6.

Consequently, the swirling flow f1 of the first rim spout W1 joining later also easily flows to the rear region B of the bowl 6 along the water flow f2 of the second rim spout W2 formed in advance in the rear region B of the bowl 6. Therefore, it is possible to surely clean the rear region B of the bowl 6 with a high-speed and large-flow rate swirling water flow.

Since the high-speed and large-flow rate first rim spout W1 can be efficiently supplied to, in a state in which the high-speed and large-flow rate first rim spout W1 interferes with the second rim spout W2, the rear region B of the bowl 6 where waste is easily adheres, it is possible to improve cleaning power of the first rim spout W1 and the second rim spout W2 that clean the waste receiving surface 14 and the rim 18 further on the rear region B side than the well portion 12 of the bowl 6.

In the flush toilet 1 according to this embodiment, the second rim spout port 22 is disposed further in the front than the rear end of the well portion 12.

Consequently, the swirling flow f1 of the first rim spout W1 spouted from the first rim spout port 20 can be caused to join and interfere with the water flow f2 of the second rim spout W2 spouted by the second rim spout port 22 relatively earlier in terms of timing.

Therefore, a part of the swirling flow f1 of the high-speed and large-flow rate first rim spout W1 can be dropped to an upstream side of the rear region B of the bowl 6 as well. Consequently, since the rear region B of the bowl 6 where waste easily adheres and an upstream side (front side) region of the rear region B can be cleaned in a wide range, it is possible to improve the cleaning power.

In the flush toilet 1 according to this embodiment, the second rim spout port 22 is disposed further in the rear than the front end T of the well portion 12.

Consequently, it is possible to prevent the swirling flow f1 of the first rim spout W1 spouted from the first rim spout port 20 from joining and interfering with the water flow f2 of the second rim spout W2 spouted by the second rim spout port 22 from being excessively earlier in terms of timing.

Therefore, it is possible to prevent most of the swirling flow f1 of the high-speed and large-flow rate first rim spout W1 from dropping early further on the upstream side (the front side) than the right rear region RB of the bowl 6 before reaching near the second rim spout port 22.

Further, in the flush toilet 1 according to this embodiment explained above, the second rim spout port 22 is disposed further in the rear than the center (the center O1) in the front-rear direction of the well portion 12.

Consequently, it is possible to cause, immediately before the rear region B of the bowl 6, the swirling flow f1 of the high-speed and large-flow rate first rim spout W1 to join and interfere with the water flow f2 of the second rim spout W2 spouted to traverse the swirling flow f1 from the second rim spout port 22. It is possible to moderately drop a part of the flush water after the joining.

Therefore, it is possible to efficiently clean, in a wide range, the waste receiving surface 14 and the rim 18 in the rear region B of the bowl 6 where waste easily adheres.

In the flush toilet 1 according to this embodiment, the opening end face of the second rim spout port 22 is directed obliquely rearward.

Consequently, the water flow f2 of the second rim spout W2 spouted from the second rim spout port 22 can be directed obliquely rearward to traverse the left-right direction of the rear region B of the bowl 6.

Therefore, it is possible to guide the swirling flow f1 of the high-speed and large-flow rate first rim spout W1 and the second rim spout W2, which is spouted obliquely rearward, over the entire left-right direction of the rear region B of the bowl 6 while causing the swirling flow f1 of the first rim spout W1 and the second rim spout W2 to interfere.

Further, with the flush toilet 1 according to this embodiment, the second rim spout W2 can be radially diffused by the diffusing portion D of the second rim spout port 22 toward the right rear region RB of the bowl 6 obliquely rearward from the second rim spout port 22.

Consequently, since the second rim spout W2 can be formed in the film shape more widely than the swirling flow f1 of the first rim spout W1, it is possible to guide, to a wide range over the entire left-right direction and front-rear direction of the rear region B of the bowl 6, the swirling flow f1 of the high-speed and large-flow rate first rim spout W1 and the wide film-like water flow f2 of the second rim spout W2 spouted obliquely rearward while causing the swirling flow of the first rim spout W1 and the water flow f2 of the second rim spout W2 to interfere.

In the flush toilet 1 according to this embodiment, the direction of the channel center axis of the diffusing portion D of the second rim spout port 22 (the channel center axis C1 of the second rim spout port 22 and the downstream side conduit 34*b* of the second bent conduit 34) forms the angle $\alpha$1 with respect to the contact plane T1 of the rim inner wall surface 18*a* near the downstream side of the second rim spout port 22 in the rim 18.

Consequently, it is possible to spout the second rim spout W2 from the second rim spout port 22 toward the right rear region RB of the obliquely rearward bowl 6. It is possible to radially diffuse the spouted second rim spout W2 to effectively traverse the swirling direction of the swirling flow f1 of the first rim spout W1 and form a wide film-like water flow f2.

Further, it is possible to suppress a phenomenon in which the second rim spout W2 is drawn to the rim inner wall surfaces 18*a* near the front and the rear of the second rim spout port 22 in the rim 18 (a so-called Coanda phenomenon).

Accordingly, it is possible to prevent the second rim spout W2 from flowing in the same swirling direction together with the swirling flow f1 of the first rim spout W1. It is possible to prevent all the flush water W3 after the joining from simply swirling without dropping at all in the rear region B of the bowl 6.

Consequently, it is possible to effectively guide the swirling flow f1 of the high-speed and large-flow rate first rim spout W1 and the wide film-like water flow f2 of the second rim spout W2, which spouted obliquely rearward, over the entire left-right direction and front-rear direction of the rear region B of the bowl 6 while causing the swirling flow f1 of the first rim spout W1 and the water flow f2 of the second rim spout W2 to join and moderately interfere.

Further, in the flush toilet 1 according to this embodiment, the flush water W supplied from the water storage tank 10, which is the flush water source, to the common conduit 24 branches to the first flush water W1 supplied to the first rim conduit 26 and the second flush water W2 supplied to the second rim conduit 28.

The second flush water W2 supplied to the second rim conduit 28 flows into the first bent conduit 32 in the front from the outer conduit 30 and passes through the bent portion B1 of the first bent conduit 32 to thereby turn and flow to the rear.

Thereafter, the second flush water W2 passed through the first bent conduit 32 flows into the upstream side conduit 34*a* of the second bent conduit 34 behind the first bent conduit 32 and, after being turned to the obliquely rearward downstream side conduit 34*b* in the bent portion B2 of the second bent conduit 34, passes through the downstream side conduit 34*b*, which is the diffusing portion D of the second rim spout port 22.

At this time, the flow speed of the second flush water W2 can be reduced when the second flush water W2 flowing backward to the upstream side conduit 34*a* of the second bent conduit 34 from the bent portion B1 of the first bent conduit 32 is turned obliquely rearward in the bent portion B2 of the second bent conduit 34.

Consequently, when the second rim spout W2 is spouted from the second rim spout port 22 passing through the downstream side conduit 34*b*, which is the diffusing portion D of the second rim spout port 22, since the second rim spout W2 is easily radially diffused obliquely rearward from the second rim spout port 22, it is possible to form the wide and film-like water flow f2 of the second rim spout W2.

Consequently, it is possible to cause the film-like second rim spout W2, which is wide compared with the first rim spout W1, to traverse the swirling direction of the swirling flow L1 of the high-speed and large-flow rate first rim spout W1. Therefore, it is possible to cause the first rim spout W1 and the second rim spout W2 to effectively interfere.

It is possible to effectively suppress the phenomenon in which the second rim spout W2 spouted from the second rim spout port 22 is drawn to the rim inner wall surfaces 18*a* near the front and the rear of the second rim spout port 22 in the rim 18 (a so-called Coanda phenomenon).

Accordingly, it is possible to effectively prevent the second rim spout W2 from flowing in the same swirling direction together with the swirling flow f1 of the first rim spout W1 and prevent all the flush water W3 after the joining from simply swirling without dropping at all in the rear region B of the bowl 6.

In the flush toilet 1 according to this embodiment, the diffusing portion D is the downstream side conduit 34*b* formed further on the downstream side than the bent portion B2 of the second bent conduit 34. The width d2 of the downstream side conduit 34*b* can be set larger than the width d1 of the conduit 34*a* further on the upstream side than the bent portion B2 in the second bent conduit 34.

Consequently, by turning obliquely rearward, in the bent portion B2 of the second bent conduit 34, the second flush water W2 flowing rearward from the first bent conduit 32 to the second bent conduit 34 and thereafter causing the second flush water W2 to pass through the downstream side conduit 34*b* of the second bent conduit 34, it is possible to effectively radially diffuse the second rim spout W2 spouted obliquely rearward from the second rim spout port 22 and form the wide film-like second rim spout W2.

Therefore, it is possible to more effectively guide the flush water over the entire left-right direction and front-rear direction of the rear region B of the bowl 6 while causing the swirling flow f1 of the high-speed and large-flow rate first rim spout W1 and the wide film-like water flow f2 of the second rim spout W2 spouted obliquely rearward to join and moderately interfere.

Further, in the flush toilet 1 according to this embodiment, the inclined surface S1 formed obliquely rearward from the second rim spout port 22 on the waste receiving surface 14 in the rear region B of the bowl 6 is inclined to rise toward the rear side.

Consequently, it is possible to prevent most of the flush water after the interference of the first rim spout W1 and the second rim spout W2 in the rear region B of the bowl 6 from swirling to the front side of the bowl 6 along the rim inner wall surface 18*a* of the rim 18 above the waste receiving surface 14 of the rear region B of the bowl 6.

Therefore, it is possible to make it easy to drop a part of the flush water passing the inclined surface S1 of the waste receiving surface 14 in the rear region B of the bowl 6 after the interference of the first rim spout W1 and the second rim spout W2 in the rear region B of the bowl 6.

Accordingly, it is possible to prevent all the flush water W3 after the joining in the rear region B of the bowl 6 from simply swirling without dropping at all.

It is possible to more efficiently supply the flush water (the flush water W3 after the joining), which is obtained by causing the swirling flow f1 of the high-speed and large-flow rate first rim spout W1 to join and interfere with the water flow f2 of the second rim spout W2, from the rear region B of the bowl 6 to near the first rim spout port 20 in the left side region LM and the left front region LF on the front side of the rear region B while dropping the flush water after causing the flush water to pass without the rear region B of the bowl 6.

Further, in the flush toilet 1 according to this embodiment, the upper edge 14*a* of the waste receiving surface 14 and the shelf surface 16*a* of the shelf 16 formed on the circumferential direction rear side of the bowl 6 from the bottom surface 22*a* of the second rim spout port 22 in the rear region B of the bowl 6 is inclined to rise from the front side toward the rim inner wall surface rear end 18*b* of the rim 18.

Consequently, it is possible to prevent most of the flush water after the interference of the first rim spout W1 and the second rim spout W2 in the rear region B of the bowl 6 from swirling to the front side of the bowl 6 along the rim inner wall surface 18*a* of the rim 18 above the waste receiving surface 14 and the shelf 16 in the rear region B of the bowl 6.

Therefore, it is possible to make it easy to effectively drop a part of the flush water passing the rear region B of the bowl 6 after the interference of the first rim spout W1 and the second rim spout W2 in the right rear region RB of the bowl 6.

In the flush toilet 1 according to the embodiment of the present invention explained above, the first rim spout port 20 is disposed further in the front than the front end T of the well portion 12 of the bowl 6.

Consequently, it is possible to efficiently guide the swirling flow f1 of the high-speed and large-flow rate first rim spout W1 to the waste receiving surface 14 and the rim 18 further on the rear side than the well portion 12 in the rear region B of the bowl 6.

The second rim spout W2 can be performed by the second rim spout port 22 to traverse the swirling direction of the swirling flow f1 of the first rim spout W1 spouted from the first rim spout port 20. Accordingly, it is possible to cause the swirling flow f1 of the high-speed first rim spout W1 having a large flow rate Q1 [L/min] to join and efficiently interfere with the water flow f2 of the second rim spout W2.

Consequently, even if the swirling flow f1 of the first rim spout W1 is guided in a higher-speed and larger-flow rate state to the rear region B of the bowl 6 as the first rim spout port 20 is disposed further in the front than the front end T of the well portion 12 of the bowl 6, it is possible to prevent the swirling flow f1 of the first rim spout W1 from becoming less easily drop in the rear region B of the bowl 6 after interfering with the second rim spout W2.

Therefore, it is possible to improve cleaning power of the first rim spout W1 and the second rim spout W2 that clean the waste receiving surface 14 and the rim 18 further on the rear region B side than the well portion 12 of the bowl 6.

Further, the second rim spout W2 spouted from the second rim spout port 22 can be radially diffused by the diffusing portion D of the second rim spout port 22. Therefore, the second rim spout W2 can be formed in the film shape more widely than the swirling flow f1 of the first rim spout W1. Consequently, it is possible to guide the swirling flow f1 of the high-speed and large-flow rate first rim spout W1 and the wide film-like second rim spout W2 to the rear region B of the bowl 6 while causing the swirling flow f1 of the first rim spout W1 and the second rim spout W2 to interfere.

Accordingly, it is possible to efficiently supply the high-speed and large-flow rate first rim spout W1 to the rear region B of the bowl 6 where waste easily adheres in a state in which the first rim spout W1 interferes with the second rim spout W2. Therefore, it is possible to improve cleaning power in the rear region B of the bowl 6.

With the flush toilet 1 according to this embodiment, it is possible to, with the diffusion portion D of the second rim spout port 22, guide the wide film-like second rim spout W2 spouted from the second rim spout port 22 to traverse the left-right direction of the rear region B of the bowl 6 while causing the second rim spout W2 to interfere with the swirling flow f1 of the high-speed and large-flow rate first rim spout W1.

Therefore, it is possible to clean the entire rear region B of the bowl 6 in a wide range with the swirling flow f1 of the high-speed and large-flow rate first rim spout W1 and the wide film-like water flow f2 of the second rim spout W2.

With the flush toilet 1 according to this embodiment, by guiding, with the diffusing portion D of the second rim spout port 22, the second rim spout W2 spouted from the second rim spout port 22 to the rear region B of the bowl 6 together with the swirling flow f1 of the first rim spout W1, it is possible to surely clean the rear region B of the bowl 6 where waste easily adheres.

In addition, after causing at least a part of the second rim spout W2 to traverse the left-right direction of the rear region B of the bowl 6, it is also possible to swirl the part of the second rim spout W2 to the first rim spout port 20 side along the rim inner wall surface 18*a* of the rim 18 in the rear region B of the bowl 6. Consequently, it is also possible to secure cleaning performance concerning a region from the rear region B of the bowl 6 to at least the first rim spout port 20 further in the front than the front end T of the well portion 12.

Therefore, by effectively utilizing the first rim spout W1 and the second rim spout W2, it is possible to improve cleaning power for the rear region B of the bowl 6 and it is possible to sufficiently clean the left rear region LB to the left side region LM in the front of the left rear region LB of the bowl where waste easily remains. Therefore, it is possible to secure cleaning performance over the entire bowl 6.

Further, in the flush toilet 1 according to this embodiment explained above, the direction of the channel center axis of the diffusing portion D of the second rim spout port 22 (the channel center axis C1 of the downstream side conduit 34*b* of the second bent conduit 34 and the second rim spout port 22) forms the angle $\alpha$1 with respect to the contact plane T1 of the rim inner wall surface 18*a* near the rear end of the second rim spout port 22 in the rim 18. Consequently, it is possible to spout the second rim spout W2 from the second rim spout port 22 toward the right rear region RB of the obliquely rearward bowl 6.

It is possible to radially diffuse the spouted second rim spout W2 to effectively traverse the swirling direction of the swirling flow f1 of the first rim spout W1 and form the wide film-like water flow f2.

Further, it is possible to suppress a phenomenon in which the second rim spout W2 is drawn to the rim inner wall surfaces 18*a* near the front and the rear of the second rim spout port 22 in the rim 18 (a so-called Coanda phenomenon). Accordingly, it is possible to prevent the second rim spout W2 from flowing in the same swirling direction together with the swirling flow f1 of the first rim spout W1. It is possible to prevent all the flush water W3 after the joining from simply swirling without dropping at all in the rear region B of the bowl 6.

Consequently, it is possible to effectively guide the swirling flow f1 of the high-speed and large-flow rate first rim spout W1 and the wide film-like water flow f2 of the second rim spout W2, which is spouted obliquely rearward, over the entire left-right direction and front-rear direction of the rear region B of the bowl 6 while causing the swirling flow f1 of the first rim spout W1 and the water flow f2 of the second rim spout W2 to join and moderately interfere.

With the flush toilet 1 according to this embodiment, it is possible to, with the drop-flow facilitating portion D of the second rim spout port 22, before the swirling flow f1 of the first rim spout W1 reaches the region where the swirling flow f1 joins and interferes with the second rim spout W2 in the rear region B of the bowl 6, spout the second rim spout W2 obliquely rearward to cause the second rim spout W2 to traverse the left-right direction of the rear region B of the bowl 6 in advance.

Consequently, it is possible to, in a state in which the high-speed and large-flow rate first rim spout W1 interferes with the second rim spout W2, efficiently supply the high-speed and large-flow rate first rim spout W1 to the entire left-right direction of the rear region B of the bowl 6 where waste easily adheres.

With the flush toilet 1 according to this embodiment, it is possible to, with the drop-flow facilitating portion D, which is the drop-flow facilitating portion of the second rim spout port 22, before the swirling flow f1 of the first rim spout W1 reaches the region where the swirling flow f1 joins and interferes with the second rim spout W2 in the rear region B of the bowl 6, radially diffuse the second rim spout W2 in advance obliquely rearward from the second rim spout port 22.

Consequently, it is possible to, before the swirling flow f1 of the first rim spout W1 reaches the region where the swirling flow f1 joins and interferes with the second rim spout W2 in the rear region B of the bowl 6, change the water flow f2 of the second rim spout W2 to the film-like water flow f2 wider than the swirling flow f1 of the first rim spout W1 in advance.

Therefore, it is possible to guide the swirling flow f1 of the high-speed and large-flow rate first rim spout W1 and the water flow f2 of the second rim spout W2, which is spouted obliquely rearward, over the entire left-right direction of the rear region B of the bowl 6 in a wide range while causing the swirling flow f1 of the first rim spout W1 and the water flow f2 of the second rim spout W2 to join and interfere.

Further, with the flush toilet 1 according to this embodiment explained above, it is possible to, with the diffusing portion D, which is the drop-flow facilitating portion of the second rim spout port 22, before the swirling flow f1 of the first rim spout W1 reaches the region where the swirling flow f1 joins and interferes with the water flow f2 of the second rim spout W2 in the rear region B of the bowl 6, spout the second rim spout W2 from the second rim spout port 22 to form the film-like water flow f2 of the second rim spout W2 over substantially the entire rear region B of the bowl 6 in advance.

Consequently, the swirling flow f1 of the first rim spout W1 joining later also easily flows over substantially the entire rear region B of the bowl 6 along the film-like water flow f2 of the second rim spout W2 formed in advance in the rear region B of the bowl 6. Therefore, the flush water W3 after the joining can also surely clean substantially the entire rear region B of the bowl 6 with the high-speed and large-flow rate swirling water flows f3 to f6.

With the flush toilet 1 according to this embodiment, it is possible to, with the diffusing portion D, which is the drop-flow facilitating portion of the second rim spout port 22, before the swirling flow f1 of the first rim spout W1 reaches the region where the swirling flow f1 of the first rim spout W1 joins and interferes with the second rim spout W2 in the rear region B of the bowl 6, radially diffuse the spouted second rim spout W2 from the second rim spout port 22 in advance to effectively traverse the swirling direction of the swirling flow f1 of the first rim spout W1 and form a wide film-like water flow. Consequently, it is possible to efficiently form the film-like water flow f2 of the second rim spout W2 over substantially the entire rear region B of the bowl 6 in advance.

It is possible to effectively facilitate formation of a water flow in which the second rim spout W2 forming such a film-like water flow f2 drops to the well portion 12 through the rear region B of the bowl 6.

Further, it is possible to suppress a phenomenon in which the second rim spout W2 is drawn to the rim inner wall surfaces 18*a* near the front and the rear of the second rim spout port 22 in the rim 18 (a so-called Coanda phenomenon). Accordingly, it is possible to prevent the second rim spout W2 from flowing in the same swirling direction together with the swirling flow f1 of the first rim spout W1. It is possible to prevent all the flush water W3 after the joining from simply swirling without dropping at all in the rear region B of the bowl 6.

Consequently, it is possible to, by causing the swirling flow f1 of the high-speed and large-flow rate first rim spout W1 to join and moderately interfere with the film-like water flow f2 of the second rim spout W2 spouted from the second rim spout port 22 in advance, effectively clean substantially the entire left-right direction and front-rear direction of the rear region B of the bowl 6 where waste easily adheres. It is possible to drop a part of the flush water W3 after the joining passed through the rear region B of the bowl 6 to the well portion 12.

In the flush toilet 1 according to this embodiment, the second rim conduit 28 is set to the path length smaller than the path length of the first rim conduit 26. Consequently, it is possible to perform the second rim spout W2 spouted from the second rim spout port 22 in advance at early timing before the swirling flow f1 of the first rim spout W1 reaches the region where the swirling flow f1 joins and interferes with the water flow f2 of the second rim spout W2 in the rear region B of the bowl 6. It is possible to radially diffuse the second rim spout W2 to more effectively traverse the swirling direction of the swirling flow f1 of the first rim spout W1 and form the wide film-like water flow f2 of the second rim spout W2.

It is possible to effectively facilitate formation of a water flow in which the second rim spout W2 forming such a film-like water flow f2 drops to the well portion 12 through the rear region B of the bowl 6.

Further, it is possible to suppress a phenomenon in which the second rim spout W2 spouted from the second rim spout port 22 in advance is drawn to the rim inner wall surfaces 18*a* near the front and the rear of the second rim spout port 22 in the rim 18 (a so-called Coanda phenomenon). Accordingly, it is possible to prevent the second rim spout W2 from flowing in the same swirling direction together with the swirling flow f1 of the first rim spout W1. It is possible to prevent all the flush water W3 after the joining from simply swirling without dropping at all in the rear region B of the bowl 6.

Consequently, it is possible to cause the swirling flow f1 of the high-speed and large-flow rate first rim spout W1 to join and moderately interfere with the wide film-like water flow f2 of the second rim spout W2 spouted from the second rim spout port 22 in advance. Accordingly, the flush water W3 after the joining can more effectively clean substantially the entire left-right direction and front-rear direction of the rear region B of the bowl 6 where waste easily adheres. It is possible to drop a part of the flush water W3 passed through the rear region B of the bowl 6 to the well portion 12.

In the flush toilet 1 according to this embodiment, the diffusing portion D is the downstream side conduit 34*b* formed further on the downstream side than the bent portion B2 of the second bent conduit 34. The width d2 of the downstream side conduit 34*b* can be set larger than the width d1 of the conduit 34*a* further on the upstream side than the bent portion B2 in the second bent conduit 34.

Consequently, by turning obliquely rearward, in the bent portion B2 of the second bent conduit 34, the second flush water W2 flowing rearward from the first bent conduit 32 to the second bent conduit 34 and thereafter causing the second flush water W2 to pass through the downstream side conduit 34*b* of the second bent conduit 34, it is possible to effectively radially diffuse the second rim spout W2 spouted obliquely rearward from the second rim spout port 22 and form the wide film-like second rim spout W2.

Therefore, it is possible to more effectively cause the water flow f2 of the second rim spout W2 to traverse the swirling direction of the swirling flow f1 of the first rim spout W1 from the second rim spout port 22 in advance before the swirling flow f1 of the first rim spout W1 reaches the region where the swirling flown of the first rim spout W1 joins and interferes with the water flow f2 of the second rim spout W2. The film-like water flow f2 of the second rim spout W2 can be efficiently formed in advance over substantially the entire rear region B of the bowl 6. Therefore, it is possible to efficiently facilitate such a film-like water flow f2 of the second rim spout W2 to be a water flow that drops to the well portion 12 through the rear region B of the bowl 6.

Consequently, by causing the swirling flow f1 of the high-speed and large-flow rate first rim spout W1 to join and moderately interfere with the wide film-like water flow f2 of the second rim spout W2 spouted from the second rim spout port 22 in advance, the flush water W3 after the joining can more effectively clean substantially the entire left-right direction and front-rear direction of the rear region B of the bowl 6 where waste easily adheres. It is possible to drop a part of the flush water W3 passed through the rear region B of the bowl 6 to the welt portion 12.

With the flush toilet 1 according to the embodiment of the present invention explained above, it is possible to, with the diffusing portion D, which is the swirling maintaining portion of the second rim spout port 22, cause the swirling flow f1 of the first rim spout W1 spouted from the first rim spout port 20 and the water flow f2 of the second rim spout W2 spouted from the second rim spout port 22 to join and efficiently interfere. Consequently, a part (the water flows f3 and f4 shown in FIG. 7B) of the flush water W3 after interfering is dropped toward the well portion 12 after passing through the rear region B of the bowl 6. On the other hand, the remaining part (the water flow f5 shown in FIG. 7B) more than the half of the flush water W3 after interfering can be swirled to the first rim spout port 20 while maintaining a swirling state along the rim inner wall surface 18*a* of the rim 18.

Therefore, it is possible to, by causing the swirling flow f1 of the high-speed and large-flow rate first rim spout W1 to join and moderately interfere with the second rim spout W2, while dropping a part (the water flows f3 and f4 shown in FIG. 7B) of the flush water W3 after passing the rear region B of the bowl 6 to the well portion 12, efficiently supply the remaining part (the water flow f5 shown in FIG. 7B) of the flush water W3 to the rear region B of the bowl 6 to the side region on the front side of the rear region B and near the first rim spout port 20 as well.

Consequently, it is possible to eliminate an uncleaned portion and surely clean the entire bowl 6 while improving the cleaning power for the rear region B of the bowl where waste easily adheres.

With the flush toilet 1 according to this embodiment, it is possible to set, with the swirling maintaining portion (the diffusing portion D) of the second rim spout port 22, flow speed u2 [m/s] of the water flow f2 at a spout start of the second rim spout W2 spouted from the second rim spout port 22 lower than flow speed u1 [m/s] of the swirling flow f1 of the first rim spout W1 immediately before interfering with the second rim spout W2 ($u2<u1$).

Consequently, it is possible to maintain high swirling power even in a state after the swirling flow f1 of the first rim spout W1 joins and interferes with the water flow f2 of the second rim spout W2.

Therefore, even when the first rim spout port 20 provided in the rim 18 in the left front region LF of the bowl 6 is disposed further on the front side, it is possible to surely swirl the first rim spout W1 spouted from the first rim spout port 20 to the first rim spout port 20 again.

With the flush toilet 1 according to this embodiment, it is possible to, with the diffusing portion D, which is the swirling maintaining portion of the second rim spout port 22, spout the second rim spout W2*a* in the first direction from the second rim spout port 22 toward the rear region B of the bowl 6 and spout the second rim spout W2*b* in the second direction same as the swirling direction of the swirling flow f1 of the first rim spout W1. Consequently, it is possible to diffuse the second rim spout W2 in a film shape more widely than the swirling flow f1 of the first rim spout W1.

It is possible to guide a part of the swirling flow f1 of the high-speed large-flow rate first rim spout W1 to the rear region B of the bowl 6 with the inner water flow f2*a* of the second rim spout W2 in the first direction and surely swirl, with the second rim spout W2*b* in the second direction, the remaining part of the swirling flow f1 of the high-speed and large-flow rate first rim spout W1 to the first rim spout port 20 while maintaining a swirling state along the rim inner wall surface 18*a* of the rim 18.

Further, with the flush toilet 1 according to this embodiment explained above, it is possible to, with the diffusing portion D, which is the swirling maintaining portion of the second rim spout port 22, set the first flow rate Q2*a* [L/min] of the inner water flow f2*a* of the second rim spout W2*a* in the first direction from the second rim spout port 22 toward the rear region B of the bowl 6 larger than the second flow rate Q2*b* [L/min] of the outer water flow f2*b* of the second rim spout W2 in the second direction same as the swirling direction of the swirling flow f1 of the first rim spout W1.

Consequently, it is possible to direct most of the swirling flow f1 of the high-speed and large-flow rate first rim spout W1 to the rear region B of the bowl 6.

In the flush toilet 1 according to this embodiment, in order to solve a problem in that the swirling flow f1 of the first rim spout W1 is easily decelerated when passing near the rim inner wall surface rear end 18*b* of the rim 18 having the small curvature radius ρ1 [mm] (see FIG. 5) in the plan view, the second rim spout port 22 is disposed on a predetermined rim inner wall surface 18*c* (see FIG. 6) in which the curvature radius ρ1 [mm] (see FIG. 5) in the plan view on the front upstream side in the circumferential direction from the rim inner wall surface rear end 18*b* is larger than the curvature radius ρ2 [mm] of the rim inner wall surface rear end 18*b* (ρ1>ρ2).

Consequently, it is possible to cause the swirling flow f1 of the first rim spout W1 and the second rim spout W2 to interfere on the upstream side where the curvature radius in the plan view is larger than near the rear end 18*b* of the rim inner wall surface 18*a* of the rim 18.

Therefore, it is possible to cause the high-speed and large-flow rate first rim spout W1 to interfere with the second rim spout W2 in a high flow rate state. Therefore, it is possible to make it easy to maintain a swirling state of the flush water W3 after joining and interfering.

Further, in the flush toilet 1 according to this embodiment, the direction of the channel center axis of the diffusing portion D of the second rim spout port 22 (the channel center axis C1 of the downstream side conduit 34*b* of the second bent conduit 34 and the second rim spout port 22) forms the angle α1 with respect to the contact plane T1 of the rim inner wall surface 18*a* near the rear end of the second rim spout port 22 in the rim 18.

Consequently, it is possible to cause the swirling flow f1 of the first rim spout W1 spouted from the first rim spout port 20 and the water flow f2 of the second rim spout W2 spouted from the second rim spout port 22 to efficiently interfere.

Accordingly, it is possible to, by causing the swirling flow f1 of the high-speed and large-flow rate first rim spout W1 to join and moderately interfere with the second rim spout W2, while dropping a part the flush water (the flush water W3 after the joining) after passing the rear region B of the bowl 6 toward the well portion 12, efficiently supply the remaining part of the flush water W3 to the rear region B of the bowl 6 to the side region on the front side of the rear region B and near the first rim spout port 20 as well.

With the flush toilet 1 according to this embodiment, it is possible to cause the film-like second rim spout W2, which is wide compared with the first rim spout W1, to traverse the swirling direction of the swirling flow f1 of the high-speed and large-flow rate first rim spout W1. Therefore, it is possible to cause the second rim spout W2 to more effectively interfere with the first rim spout W1.

It is also possible to more effectively suppress the phenomenon in which the second rim spout W2 spouted from the second rim spout port 22 is drawn to the rim inner wall surfaces 18*a* near the front and the rear of the second rim spout port 22 in the rim 18 (a so-called Coanda phenomenon).

Therefore, it is also possible to more efficiently supply the flush water (the flush water W3 after the joining), which is obtained by causing the swirling flow f1 of the high-speed and large-flow rate first rim spout W1 to join and interfere with the water flow f2 of the second rim spout W2, from the rear region B of the bowl 6 to near the first rim spout port 20 in the left side region LM and the left front region LF on the front side of the rear region B while dropping the flush water toward the well portion 12 after causing the flush water to pass without the rear region B of the bowl 6.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a bowl including a bowl-shaped waste receiving surface, a rim formed above the waste receiving surface, and a well portion provided below the waste receiving surface and configured to store reserved water and form sealing water;

a discharge trap portion, an inlet of which is connected to the well portion to discharge the waste;

a first rim spout portion provided in the rim on one side in a left-right direction of the bowl and configured to perform first rim spout for spouting the flush water forward and form a swirling flow swirling along the rim; and a second rim spout portion provided in the rim on another side in the left-right direction of the bowl and configured to perform second rim spout for spouting the flush water having a flow rate smaller than a flow rate of the first rim spout portion, wherein the first rim spout portion includes a first rim spout port disposed further in a front than a front end of the well portion, and the second rim spout portion includes a second rim spout port configured to cause the second rim spout to traverse a swirling direction of the swirling flow of the first rim spout and guide the flush water interfering with the swirling flow of the first rim spout to a rear region of the bowl further on a rear side than the well portion, and wherein the second rim spout port is disposed further in the front than a rear end of the well portion.

2. The flush toilet according to claim 1, wherein the second rim spout port is disposed further in the rear than the front end of the well portion.

3. The flush toilet according to claim 1, wherein the second rim spout port is disposed further in the rear than a center in a front-rear direction of the well portion.

4. The flush toilet according to claim 1, wherein an opening end face of the second rim spout port is directed obliquely rearward such that the water flow of the second rim spout traverses a left-right direction of the rear region of the bowl.

5. The flush toilet according to claim 4, wherein the second rim spout port includes a diffusing portion configured to diffuse the second rim spout in a film shape more widely than the swirling flow of the first rim spout.

6. The flush toilet according to claim 5, wherein the diffusing portion is provided such that a direction of a channel center axis of the diffusing portion forms an angle with respect to a contact plane of a rim wall surface near a rear end of the second rim spout port in the rim.

7. The flush toilet according to claim 5, further comprising a second rim conduit configured to guide the flush water supplied from the flush water source to the second rim spout portion, wherein the second rim conduit includes a first bent conduit that turns rearward the flush water flowing forward from the upstream side of the second rim conduit and a second bent conduit provided in the rear on the downstream side of the first bent conduit, the second bent conduit includes a bent portion that turns obliquely rearward the flush water turned to flow rearward by the first bent conduit, and the diffusing portion is provided further on the downstream side than the bent portion.

8. The flush toilet according to claim 7, wherein the diffusing portion is a downstream side conduit formed further on the downstream side than the bent portion of the second bent conduit, and width of the downstream side conduit is set larger than width of a conduit further on the upstream side than the bent portion in the second bent conduit.

9. The flush toilet according to claim 1, wherein, in the rear region of the bowl, a surface formed obliquely rearward from the second rim spout port on the waste receiving surface of the bowl is inclined to rise toward the rear side.

10. The flush toilet according to claim 9, wherein, in the rear region of the bowl, an upper edge of the waste receiving surface formed on a circumferential direction rear side of the bowl from a bottom surface of the second rim spout port is inclined to rise from the front side toward a rear end of the rim.

* * * * *